US006720541B2

(12) United States Patent
Watanabe et al.

(10) Patent No.: US 6,720,541 B2
(45) Date of Patent: Apr. 13, 2004

(54) HIGH FREQUENCY HEATING APPARATUS WITH TEMPERATURE DETECTION MEANS

(75) Inventors: Kenji Watanabe, Nara (JP); Kazuo Fujishita, Nara (JP); Tomotaka Nobue, Yamatokoriyama (JP); Takesi Takizaki, Kyoto (JP); Isao Mizuta, Tenri (JP); Akemi Fukumoto, Toyonaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 232 days.

(21) Appl. No.: 10/018,435

(22) PCT Filed: Mar. 30, 2001

(86) PCT No.: PCT/JP01/02759

§ 371 (c)(1),
(2), (4) Date: Dec. 13, 2001

(87) PCT Pub. No.: WO01/80602

PCT Pub. Date: Oct. 25, 2001

(65) Prior Publication Data

US 2003/0047559 A1 Mar. 13, 2003

(30) Foreign Application Priority Data

| | | |
|---|---|---|
| Apr. 17, 2000 | (JP) | 2000-114788 |
| Apr. 17, 2000 | (JP) | 2000-114789 |
| Apr. 17, 2000 | (JP) | 2000-114792 |
| Oct. 17, 2000 | (JP) | 2000-316177 |

(51) Int. Cl.[7] ..... H05B 6/68; H05B 6/78

(52) U.S. Cl. ..... 219/711; 219/754; 219/749; 219/494; 374/149; 99/325

(58) Field of Search ..... 219/710, 711, 219/754, 746, 748, 749, 494, 510; 374/149, 121; 99/325

(56) References Cited

U.S. PATENT DOCUMENTS

| | | | | |
|---|---|---|---|---|
| 4,456,806 A | * | 6/1984 | Arimatsu | 219/710 |
| 5,986,249 A | | 11/1999 | Yoshino et al. | 219/746 |
| 6,586,714 B2 | * | 7/2003 | Kawamura et al. | 219/711 |

FOREIGN PATENT DOCUMENTS

| | | |
|---|---|---|
| EP | 0 874 198 | 10/1998 |

* cited by examiner

*Primary Examiner*—Philip H. Leung
(74) *Attorney, Agent, or Firm*—Pearne & Gordon LLP

(57) ABSTRACT

A high-frequency heating apparatus capable of simultaneously heating different kinds of objects to appropriate temperatures includes: a power feed portion provided on a right side wall forming a heating chamber; a mounting table on which to mount objects to be heated; a rotating support of an improved structure; a drive motor; a temperature detection means having an area in front of the power feed portion as a detection area; and a control means; wherein high-frequency radiation variations are formed by the power feed portion and the rotating support and, based on a signal from the temperature detection means, the control means identifies positions of the objects on the mounting table and controls the drive motor to move the lower-temperature object to where a high-frequency radiation is strong to eliminate insufficient heating of the object and to simultaneously heat a plurality of objects to appropriate temperatures.

12 Claims, 16 Drawing Sheets

HIGH FREQUENCY HEATING APPARATUS WITH TEMPERATURE DETECTION MEANS

This application claims the benefit of International Application Number PCT/JP01/02759, which was published in English on Oct. 25, 2001.

TECHNICAL FIELD

The present invention relates to a high-frequency heating apparatus for heating a single object and for simultaneously heating a plurality of objects which have different temperatures at the start of heating or different heat absorbing capacities, and also to a heating method.

BACKGROUND ART

Examples of conventional apparatuses of this kind are disclosed in the Unexamined Japanese Patent Application Publication Nos. Hei6-201137 and No. Hei9-27389 and control the heating of objects based on a detection signal from a temperature detection means.

FIGS. 22 and 23 show a combination of a temperature detection means 2 for an object 1 being heated, which is described in the Unexamined Japanese Patent Application Publication No. Hei6-201137, and a mounting table 3. FIG. 22 shows an apparatus which includes amounting table 3 mounted with an object 1 and adapted to be rotated and a temperature detection means 2 for the object 1. An infrared sensor is used for the temperature detection means 2, and the radius segment of the rotatable mounting table 3 is taken as an angle of view. FIG. 23 shows an apparatus in which the infrared sensor is swung by a drive means 4 so that the radius segment of the mounting table 3 defines a view angle. In either case, temperature detection means 2 is situated above a heating chamber 5.

According to the Unexamined Japanese Patent Application Publication No. Hei9-27389, as shown in FIG. 24 and FIG. 25, the apparatus has a plurality of power feed portions 11*a*, 11*b* for supplying high frequency electromagnetic wave and alternately switches between these power feed portions to perform concentrated or distributed heating to eliminate temperature variations. This apparatus is intended to heat a single object.

In FIGS. 24 and 25, the apparatus has a temperature detection means 13 for an object 12 being heated, a plurality of power feed portions 11*a*, 11*b* for feeding high frequencies to a heating chamber 14, and a distribution change means 15 for changing the positions of the power feed portions 11. There are a plurality of power feed portions 11 and they are alternately switched on to perform concentrated or distributed heating thereby eliminating temperature variations. When the peripheral portion of the object 12 on a rotating table 16 becomes hot, the power feed portion 11*a* is opened to switch to the concentrated heating of the central part. When the central part of the object 12 on the rotating table 16 becomes hot, the power feed portion 11*b* is opened to switch to the distributed heating over a wide area.

Further, the same official gazette also discloses another apparatus which, as shown in FIGS. 26 to 28, has a combination of a temperature detection means 18 for an object 17 and amounting table 19 that does not rotate, with an infrared sensor as the temperature detection means 18 arranged to take the entire mounting table 19 as its view angle. The apparatus also includes a shield plate 21 formed with an opening as a power feed portion 20*a* and a shield plate 22 formed with an opening as a power feed portion 20*b*. The shield plates 21, 22 are rotated in combination.

When the peripheral portion of an object 17 becomes hot, the rotation combination is switched so that the central part of the power feed portion 20*a* is open. When the central part of the object 17 becomes hot, the rotation combination is switched so that the peripheral part of the power feed portion 20*a* is open. The power feed portions 20*a*, 20*b* are situated immediately below a bottom surface wall of the mounting table 19 and the temperature detection means 18 is situated above a top surface wall of a heating chamber 23.

That is, the apparatus of the Unexamined Japanese Patent Application Publication No. Hei6-201137 uses a combination of the rotating table and the temperature detection means, which takes almost the radius segment of the rotating table as its view angle. The apparatus of the Unexamined Japanese Patent Application Publication No. Hei9-27389 has a plurality of power feed portions for supplying a high-frequency radiation and performs local heating by selecting one of the power feed portions and uniform heating by alternately turning them on. Further, the other apparatus of the Unexamined Japanese Patent Application Publication No. Hei9-27389 combines the non-rotating mounting table 19 with the temperature detection means which takes almost the entire mounting table 19 as the angle of view.

DISCLOSURE OF INVENTION

However, the conventional configurations all heat the objects under the same condition (same temperature, same kind and same heat absorbing capacity). Hence, the angle of view of the temperature detection means does not matter much.

When the heating that applies a high frequency radiation to all objects is combined with the heating that high-frequency-heats a particular object concentratedly as in this embodiment, new problems arise in realizing the simultaneous heating of a plurality of objects having different temperatures at the start of heating or different heat absorbing capacities to the same temperature, not possible with the conventional high-frequency heating apparatus.

That is, when a plurality of objects are heated simultaneously, if a temperature difference between the objects being heated is detected, the rotation of the mounting table is stopped so that the lower-temperature object is situated near the power feed portion for concentrated heating by the high-frequency radiation. Hence, the temperature of the object on the mounting table near the power feed portion must be able to be detected by the temperature detection means. In the case of the temperature detection means which uses roughly a radius segment of the mounting table at a particular location as its angle of view, if the positions of the power feed portion and the temperature detection means are not appropriate, the temperature of the object cannot be detected.

Further, one of the apparatus disclosed in the Japanese Patent Application Publication No. Hei9-27389 basically performs heating by rotating the mounting table to heat the objects evenly and, when temperature variations occur, the heating mode is switched to a concentrated heating or distributed heating to eliminate the temperature variations. Another apparatus basically performs heating by moving the power feed portion, rather than rotating the mounting table, to heat the objects evenly and, when temperature variations occur, the apparatus switches the power feed portion to the central or peripheral one to effect the concentrated heating and thereby eliminate the temperature variations. With these conventional apparatus, however, the power feed portion is moved and rotated and a waveguide 24 and power feed portions 20*a*, 20*b* are located at positions directly connected to a high-frequency generation means 25 where the electric field intensity is very strong. Moving the waveguide 24 and power feed portions formed of a metal (they are difficult to fabricate using materials other than metals) at positions exposed to a strong electric field will easily result in such phenomena as heating and spark due to electric field concentrations. Hence, the practical use of this arrangement is very difficult to realize.

Further, when a plurality of objects with different heat absorbing capacities, such as milk in a large cup and milk in a small cup, are to be heated simultaneously by the conventional apparatus of these arrangements, it is likewise not possible to simultaneously heat a plurality of objects to the same temperatures.

The present invention has been accomplished to solve the problems described above and provide a high-frequency heating apparatus and a heating method which can eliminate the necessity of moving and rotating the power feed portion and which can not only heat a single object to an appropriate temperature but also simultaneously heat a plurality of objects in different states having different temperatures at the start of heating and/or different heat absorbing capacities to the same temperatures.

To realize these, it is another object to provide a detailed arrangement that forms variations in a high-frequency radiation intensity in the heating chamber and also a means for taking advantage of this arrangement.

It is still another object to optimize a temperature detection means detection position for an area formed in the heating chamber near the power feed portion where the high-frequency radiation is strong.

When heating a particular object concentratedly with a high-frequency radiation, it is a further object to occasionally detect the temperatures of objects other than the particular object to select a lower-temperature object at all times and heat it concentratedly, thereby heating a plurality of objects to almost the same temperatures.

To solve the problems described above, the high-frequency heating apparatus of this invention positively forms variations in high-frequency radiation intensity in the heating chamber by the radiation variation means, puts a lower-temperature object or a lower-temperature part of the object at a position where the radiation is strong, and heat it while monitoring the surface temperature of the object by an infrared sensor, the temperature detection means.

With this invention, by strongly heating the lower-temperature object among a plurality of different kinds of objects or a lower-temperature part of the object while monitoring the surface temperature of the object, it is possible to eliminate the insufficient heating of one object relative to other objects.

Further, the high-frequency heating apparatus comprises: a power feed portion to supply a high-frequency power to a heating chamber; a mounting table to mount a plurality of objects to be heated thereon and apply more of the high-frequency power to the object located near the power feed portion than to objects located elsewhere; a temperature detection means to detect temperatures of the plurality of objects when the mounting table is rotating and, when the mounting table is stopped, monitor a temperature change of at least the object near the power feed portion; a decision means to determine a temperature difference between the objects being heated based on a detection result obtained from the temperature detection means when the mounting table is rotating; and a control means to stop the rotation of the mounting table when the lower-temperature object comes near the power feed portion according to a decision made by the decision means and to heat the object concentratedly and at the same time occasionally rotate the mounting table to check for a possible change of the lower-temperature object.

Further, when a plurality of objects are heated simultaneously, at least at some point during the heating operation, a lowest-temperature object is heated at a position where a high-frequency radiation is strongest in order to eliminate temperature differences among the objects being heated.

With this invention, the high-frequency heating by rotating the mounting table and the concentrated high-frequency heating of a particular object by stopping the mounting table can be combined, making it possible to simultaneously heat a plurality of objects having different temperatures at the start of heating and/or different heat absorbing capacities to the same temperatures, which has not been possible with the conventional high-frequency heating apparatus. This is very convenient. Further, because the power feed portion is not varied, phenomena such as heating and spark due to electric field concentrations do not occur and the apparatus can be realized with a simple construction. Further, a variety of choices is available according to the needs of the overall arrangement. For example, possible choices include a low-cost type, a simple structure type and intermediate type.

Figure 1:
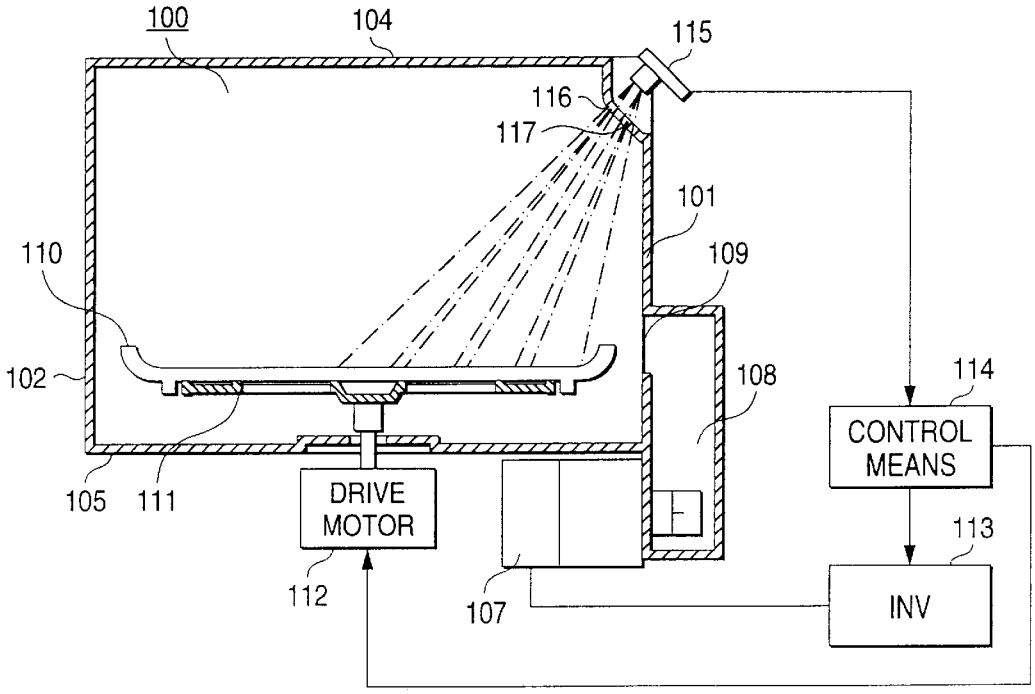
[FIG. 1]

An outline configuration of a high-frequency heating apparatus as embodiment 1 of the invention.

[FIG. 2]

An essential-part cross section of the high-frequency heating apparatus.

[FIG. 3]

An outline configuration of a rotating support in the high-frequency heating apparatus.

[FIG. 4]

A flow chart showing a process of control performed by the high-frequency heating apparatus.

[FIG. 5]

(a) A diagram showing how a heating control is performed in the high-frequency heating apparatus.

(b) A diagram showing how a heating control is performed in the high-frequency heating apparatus.

[FIG. 6]

(a) A diagram showing how another heating control is performed in the high-frequency heating apparatus.

(b) A diagram showing how another heating control is performed in the high-frequency heating apparatus.

[FIG. 7]

An outline cross section of a high-frequency heating apparatus as embodiment 2 of the invention.

[FIG. 8]

An operation block diagram.

[FIG. 9]

A diagram showing addresses allocated to the mounting table.

[FIG. 10]

An essential-part cross section of the temperature detection means.

[FIG. 11]

A conceptual diagram showing how a plurality of objects with different temperatures at the start of heating are heated evenly.

[FIG. 12]

A conceptual diagram showing the concentrated heating.

[FIG. 13]

A conceptual diagram showing how large and small cups with different heat absorbing capacities are heated in the high-frequency heating apparatus.

[FIG. 14]

A conceptual diagram showing the concentrated heating in the high-frequency heating apparatus.

[FIG. 15]

A diagram showing a positional relation between the power feed portion and the temperature detection means.

[FIG. 16]

An outline diagram of the high-frequency heating apparatus as embodiment 3 of the invention, showing the temperature detection means using roughly the diameter of the mounting table as its angle of view.

[FIG. 17]

A front conceptual diagram showing the concentrated heating.

[FIG. 18]

An outline diagram of the high-frequency heating apparatus as embodiment 4 of the invention, showing the temperature detection means having a single detection element and a drive means.

[FIG. 19]

A conceptual diagram of the high-frequency heating apparatus as embodiment 5 of the invention, showing another temperature detection means having a single detection element and a drive means.

[FIG. 20]

A conceptual diagram of the high-frequency heating apparatus as embodiment 6 of the invention, showing a plurality of temperature detection means.

[FIG. 21]

A schematic side view showing the concentrated heating.

[FIG. 22]

A schematic diagram showing a conventional heating apparatus.

[FIG. 23]

A schematic diagram showing a type of apparatus using a drive means.

[FIG. 24]

A cross section showing another conventional heating apparatus.

[FIG. 25]

A plan view of a power feed portion in the conventional apparatus.

[FIG. 26]

A cross section showing still another conventional heating apparatus.

[FIG. 27]

A plan view of a shielding plate in the conventional apparatus.

[FIG. 28]

A plan view of another shielding plate in the conventional apparatus.

DESCRIPTION OF REFERENCE NUMERALS

100, 202: Heating chamber
107, 205: Magnetron (high-frequency radiation generation means)
109, 207: Power feed portion (radiation variation means)
110, 203: Mounting table
111: Rotating support (radiation variation means)
112, 204: Drive motor (rotation drive means)
114, 211: Control means
115, 208, 222, 223, 226*a*, 226*b*: Temperature detection means
118*a*, 118*b*, 118*c*, 118*d*: Detection areas of infrared sensors
201, 216, 217, 218, 219: Objects to be heated
210: Decision means
213: Multiple detection elements
216, 218: Lower-temperature object
224, 225: Drive means of temperature measuring means

BEST MODE FOR CARRYING OUT THE INVENTION

The invention according to claim 1 includes: a temperature detection means installed in a heating chamber to detect surface temperatures of an object to be dielectric-heated; and a radiation variation means to form variations in a high-frequency radiation intensity in the heating chamber; wherein the object mounted where the radiation is strong is heated while monitoring a surface temperature of the object by the temperature detection means.

Of a plurality of different kinds of objects, a lower-temperature object or a lower-temperature part of the object is strongly heated while monitoring its surface temperature by the infrared sensor, the temperature detection means, to eliminate any insufficient heating.

The invention according to claim 2 includes: a mounting table on which to mount an object to be heated; a rotation drive means to rotate the mounting table; a temperature detection means to cover almost an entire area of the mounting table as a detection area by rotating the mounting table; and a radiation variation means to form variations in a high-frequency radiation intensity in the heating chamber; wherein when the object comes to where the radiation is strong, the rotation of the mounting table is stopped to heat the object while monitoring a surface temperature of the object by the temperature detection means.

Then, a lower-temperature object is selected by the temperature detection means and is stopped where the radiation is strong in order to heat it while monitoring its temperature. This eliminates any insufficient heating.

Particularly in the apparatus of claim 1 or 2, the invention according to claim 3 is characterized in that the object is made up of a plurality of different kinds of objects and a lowest-temperature object is brought to where the radiation is strong. When a plurality of objects exist, the mounting table is stopped according to the temperature information on the objects so that a lower-temperature object is within the detection area of the infrared sensor, the temperature detection means. The lower-temperature object placed in the detection area of the infrared sensor is strongly heated by the high-frequency radiation so that it can be heated simultaneously with other objects to an appropriate temperature. Thus a plurality of objects or different kinds of objects can be heated simultaneously to proper temperatures.

The invention according to claim 4 is characterized in that the radiation variation means described in claim 1 or 2 in particular comprises a power feed portion for supplying a high-frequency power to the heating chamber accommodating the object and a rotating support on which to mount the mounting table.

The invention according to claim 5 is characterized in that a gap between a peripheral part of the rotating support and the power feed portion is equal to about ¼ a propagation wavelength of the high-frequency radiation in a waveguide that transmits the high-frequency radiation generated by a high-frequency radiation generation means to the power feed portion. The high-frequency radiation emitted from the power feed portion into the heating chamber couples to the peripheral part of the rotating support and propagates on the rotating support. Hence, even when the object is put at nearly the center of the mounting table, it is possible to heat the side near the power feed portion more strongly than the opposite side.

The invention according to claim 6 comprises: a heating chamber to accommodate an object to be heated; a power feed portion to supply a high-frequency power to the heating chamber;

a mounting table on which to mount the object; a rotation drive means to rotate the mounting table; a temperature detection means to cover almost an entire area of the mounting table as a detection area by rotating the mounting table; and a means to stop the rotation of the mounting table when the object on the mounting table is within the detection area of the temperature detection means. By monitoring the heating state of the object on the mounting table at all times, underheating or overheating of the object can be eliminated. Further, for simultaneous heating of a plurality of objects, the heating states of the plurality of objects can be monitored alternately in a predetermined temperature cycle to eliminate underheating or overheating of the individual objects.

The invention according to claim 7 comprises: a power feed portion to supply a high-frequency power to a heating chamber; a mounting table to mount a plurality of objects to be heated thereon and apply more of the high-frequency power to the object located near the power feed portion than to objects located elsewhere; a temperature detection means to detect temperatures of the plurality of objects when the mounting table is rotating and, when the mounting table is stopped, monitor a temperature change of at least the object near the power feed portion; a decision means to determine a temperature difference between the objects being heated based on a detection result obtained from the temperature detection means when the mounting table is rotating; and a control means to stop the rotation of the mounting table when the lower-temperature object comes near the power feed portion according to a decision made by the decision means and to heat the object concentratedly and at the same time occasionally rotate the mounting table to check for a possible change of the lower-temperature object.

Because the temperature detection means can precisely detect the temperature of the lower-temperature object during the concentrated heating and because the temperatures of a plurality of objects can be detected during heating by occasionally rotating the mounting table to check whether the lowest-temperature object has been changed or not, the objects can be heated simultaneously to almost the same temperatures.

The invention according to claim 8 is characterized in that the temperature detection means described in claim 7 in particular has a plurality of infrared detection elements to detect temperatures by taking roughly a radius segment of the mounting table on a line connecting the power feed portion and a center of the mounting table as its angle of view covered by the plurality of detection elements.

Because the temperature detection means is made up of a small number of infrared detection elements, it can be realized inexpensively.

The invention according to claim 9 is characterized in that the temperature detection means described in claim 7 in particular has a plurality of infrared detection elements to detect temperatures by taking roughly a diameter segment of the mounting table on a line connecting the power feed portion and a center of the mounting table as its angle of view covered by the plurality of detection elements.

Although the use of the temperature detection means, which takes roughly the diameter segment of the mounting table as its angle of view covered by the plurality of detection elements, increases the number of elements (for example, eight elements) and therefore slightly raises its cost, there is no need to add a heating control for checking the temperature difference.

The invention according to claim 10 is characterized in that the temperature detection means described in claim 7 in particular has a single infrared detection element combined with a drive means to detect temperatures by taking roughly a radius segment of the mounting table on a line connecting the power feed portion and a center of the mounting table as its angle of view.

Although this arrangement requires a stepping motor for the swing drive and needs to additionally perform the heating control for checking the temperature difference, the temperature detection means has the minimum number of detection elements and thus can be constructed at a reduced cost.

The invention according to claim 11 is characterized in that the temperature detection means described in claim 7 in particular has a single infrared detection element combined with a drive means to detect temperatures by taking roughly a radius segment of the mounting table on a line connecting the power feed portion and a center of the mounting table as its angle of view when the mounting table is rotating and, when the mounting table is at rest, taking roughly a diameter segment of the mounting table on a line connecting the power feed portion and a center of the mounting table as its angle of view.

Although this arrangement requires a stepping motor for the swing drive and needs to additionally perform the drive controls, one taking the radius as the angle of view and one taking the diameter as the angle of view, there is no need to add the heating control for checking the temperature difference and the temperature detection means has a minimum number of elements and thus can be constructed at a reduced cost.

The invention according to claim 12 is characterized in that the temperature detection means described in claim 7 in particular comprises a combination of a temperature detection means A and a temperature detection means B, each having a plurality of infrared detection elements, the temperature detection means A being adapted to take roughly a radius segment of the mounting table on a line connecting the power feed portion and a center of the mounting table as its angle of view, the temperature detection means B being adapted to take roughly a remaining radius segment of the mounting table as its angle of view.

Although this arrangement uses a plurality of temperature detection means each having a plurality of detection elements and slightly raises the cost, there is no need to add the heating control for checking the temperature difference, simplifying the control operation.

The invention according to claim 13 comprises: a heating chamber to accommodate objects to be heated; a high-frequency radiation generation means to generate a high-frequency radiation; a power feed portion to supply the high-frequency radiation generated by the high-frequency radiation generation means to the heating chamber; a drive power supply to drive the high-frequency radiation generation means; a mounting table on which to mount the objects to be heated; a rotating support on which to mount the mounting table and to form variations in a high-frequency radiation intensity in the heating chamber in cooperation with the power feed portion; a rotation drive means to drive the rotating support; a temperature detection means to cover almost an entire area of the mounting table as a detection area as the mounting table rotates; and a control means to control the operations of the drive power supply and the rotation drive means according to a temperature distribution of the objects as represented by a detection signal from the temperature detection means and utilize the variations in the high-frequency radiation intensity in heating a lower-temperature object with a strong high-frequency radiation and heating a higher-temperature object with a weak high-frequency radiation to heat the entire objects with high-frequency radiations to an appropriate temperature.

When there are variations in the temperature distribution of the objects, the rotation drive means is controlled to have the lower-temperature object stay long where the high-frequency radiation is strong, thereby contributing to making the entire temperature distribution of the objects uniform.

The invention according to claim 14 is characterized in that the control means described in claim 13 in particular controls the rotation drive means so that when the control means decides that a temperature difference between maximum and minimum temperatures in a temperature distribution of the objects as represented by the detection signal from the temperature detection means exceeds a predetermined value, the minimum temperature object is brought to a position facing the power feed portion where the high-frequency radiation is strong before stopping the rotation of the mounting table, and that when a predetermined stop reset condition is met, the mounting table is rotated again.

The lowest-temperature object is supplied continuously with a strong high-frequency radiation t eliminate the temperature difference between the highest and lowest temperatures. By using the predetermined stop reset condition, it is possible to prevent abnormal heating or localized heating of the lowest-temperature object and further contribute to making the overall temperature distribution of the objects uniform.

The invention according to claim 15 is characterized in that the stop reset condition described in claim 14 in particular is an absolute temperature value based on the maximum temperature in the temperature distribution of the objects obtained before the mounting table stopped rotating or a temperature rise value based on the temperature difference between the maximum and minimum temperatures.

When the mounting table is at rest, the temperature change of the lowest-temperature object introduced to the strong high-frequency radiation area is monitored by the temperature detection means. When the monitored temperature exceeds the maximum temperature value that is recorded prior to the stopping of the mounting table or a predetermined temperature rise results, the mounting table is rotated again to prevent abnormal heating or localized heating.

The invention according to claim 16 is characterized in that the stop reset condition described in claim 14 in particular is a predetermined rest time associated with the stopping of the rotation of the mounting table.

By rotating the mounting table again to heat the entire objects even when a predetermined temperature rise does not occur during the predetermined rest time, a possible localized heating which may result from the stopping of the mounting table can be prevented. This is particularly effective in simultaneously heating a plurality of mixed kinds of frozen objects.

The invention according to claim 17 provides a method of controlling a high-frequency heating to simultaneously heat a plurality of objects having different temperatures at the start of heating and/or a plurality of objects having different heat absorbing capacities, wherein at least at some point during the heating operation a lowest-temperature object is heated at a position where a high-frequency radiation is strongest in order to heat the plurality of objects to have almost the same temperatures at the end of the heating operation.

Because the low-temperature object is heated concentratedly at a position where the high-frequency radiation is strong, the temperature of the heated part can easily rise to almost the same temperature of other objects.

The invention according to claim 18 provides a method of controlling a high-frequency heating to simultaneously heat a plurality of objects having different temperatures at the start of heating and/or a plurality of objects having different heat absorbing capacities, wherein two steps are combined in order to heat the plurality of objects to have almost the same temperatures at the end of the heating operation, one of the steps being adapted to rotate a mounting table on which the plurality of objects are mounted to heat them with a high-frequency radiation, the other of the steps being adapted to stop the rotation of the mounting table to heat a specific object concentratedly with a high-frequency radiation.

Examples of food combinations with different temperatures at the start of heating include a combination of frozen rice and cold miso-soup and a combination of frozen rice and refrigerated hamburger. Examples of food combinations with different heat absorbing capacities include a combination of milk in a large cup and milk in a small cup. These food combinations can be simultaneously heated to the same temperatures. This is very useful.

Now, embodiments of this invention will be described by referring to the accompanying drawings.

Embodiment 1

Figure 2:
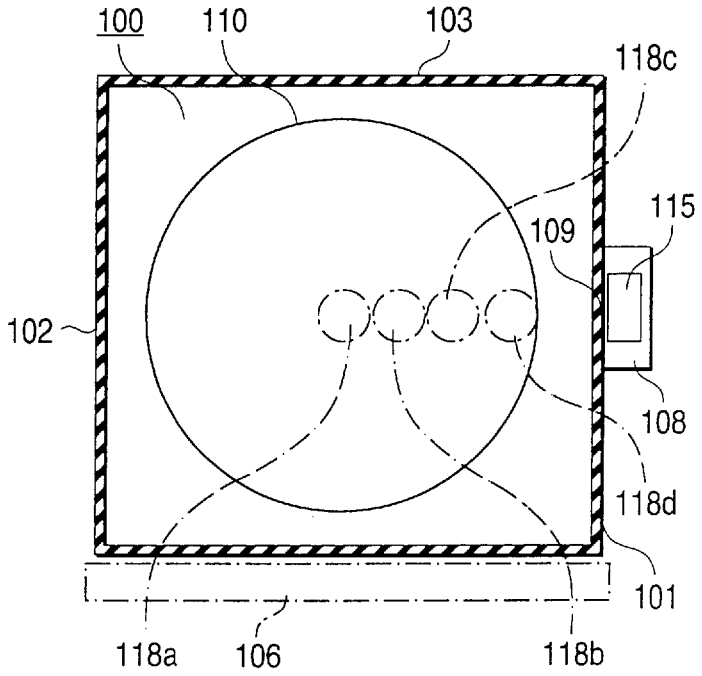

FIG. 1 is an outline configuration of a high-frequency heating apparatus as embodiment 1 of this invention. FIG. 2 is a cross-sectional configuration of FIG. 1.

In FIG. 1 and FIG. 2, a heating chamber 100 is shaped almost like a rectangular parallelepiped and comprises a metal enclosure made of a metallic material, which has a right side wall 101, a left side wall 102, a rear wall 103, a top wall 104 and a bottom wall 105, and a door 106 that constitutes an open-close wall through which an object to be heated is taken into or out of the heating chamber 100. The heating chamber 100 virtually contains therein a high-frequency radiation supplied. Denoted 107 is a magnetron, a means for generating a high-frequency radiation to be supplied to the heating chamber 100; 108 a waveguide for introducing the high-frequency radiation generated by the magnetron 107 to the heating chamber 100; and 109 a power feed portion for connecting the waveguide 108 with the heating chamber 100 by the high-frequency radiation and for emitting the high-frequency radiation generated by the magnetron 107 into the heating chamber 100. The power feed portion 109 is provided at a longitudinally central part of the right side wall 101 when viewed from the door 106. Reference number 110 represents a mounting table 110 on which an object to be heated is placed. The mounting table 110 is put on a rotating support 111. A drive motor 112 is a means for rotating the mounting table 110 along with the rotating support 111 and rotates in one direction only. Operating the drive motor 112 causes the rotating support 111 and the mounting table 110 to be turned.

Denoted 113 is an inverter-driven power supply unit 113, and 114 is a control means for controlling the operation of the entire apparatus. An infrared sensor 115, a temperature detection means, has four detection elements. The detection elements detect, through two holes 116, 117 in the right side wall 101, the amount of infrared radiations from the surface of the mounting table 110 or, when an object is mounted, the amount of infrared radiations from the surface of the object, and sends a detection signal to the control means 114. Detection areas of the four detection elements of the infrared sensor 115 are set to those areas indicated by circles of chain-dotted line 118*a*–118*d* in FIG. 2. The detection area 118*a* is set to an almost central area of the mounting table 110, the detection area 118*d* is set to a peripheral area of the mounting table 110, and the detection areas 118*b*, 118*c* are set to intermediate areas. According to heating information input from the operation unit as well as signals from the infrared sensor 115 and from a weight sensor (not shown), which detects the weight of the object through the rotating shaft of the drive motor 112, the control means 114 controls the operation of the inverter-driven power supply unit 113 and the operation of the drive motor 112 to dielectric-heat the object accommodated in the heating chamber 100.

The mounting table 110 is made of a ceramic material and the rotating support 111 is made of a metal material. Outside the bottom wall 105 and the top wall 104 of the heating chamber 100, a radiation heater (not shown) may be provided.

The operation unit has a "thaw" key and a "warm" key, both for automatic heating control; a "heating time input section" and a "heating temperature input section", both for executing the heating according to the intension of the user; a display section for displaying the temperature of the object being heated; a "start" key for starting the heating operation; and a "cancel" key for clearing the input condition or canceling the heating operation.

Figure 3:
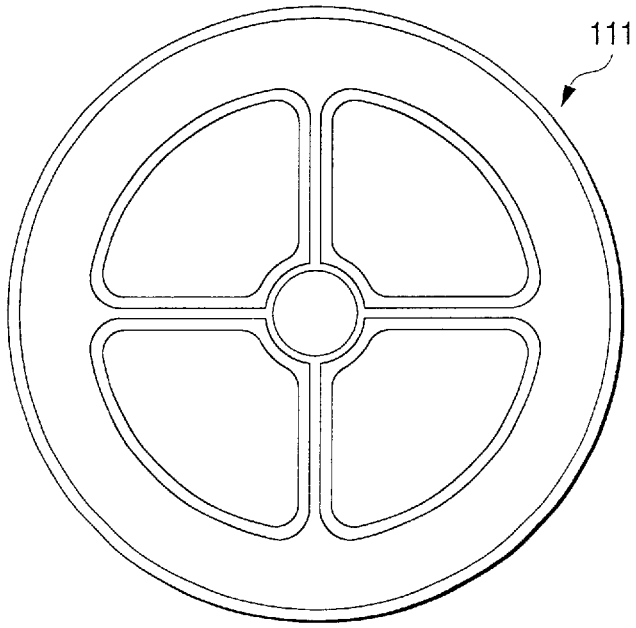

Next, a means for heating different kinds of objects to their proper temperatures, i.e., an electromagnetic radiation un-uniform distribution means and its operation, which constitutes the primary object of this invention, will be described by referring to FIG. 3. FIG. 3 is an outline view of the rotating support 111.

A target performance to meet the above requirement and a test conducted to achieve that performance will be described below.

First, as the target performance, a level of un-uniformity in an intensity distribution of high-frequency radiation in the heating chamber 100 is set such that 100 cc and 200 cc of water are heated to the same temperatures. When, with the diameter segment of the mounting table 110 divided into four equal parts, two mugs containing 200 cc of water are placed on the mounting table, one each at the central part of two segments on the left side and on the right side with respect to the center of the table, the rate of temperature rise for the mug placed on the power feed portion side is set to about 1.5 times that of the other mug.

This target value is determined from the necessary condition for heating 100 cc and 200 cc of water to the same temperatures by considering the fact that when two mugs each containing 200 cc of water are mounted on the mounting table under the condition described above and the mounting table is rotated, the temperature rise characteristics of the water of both mugs are almost identical and that when mugs containing 100 cc and 200 cc of water are placed on the rotating mounting table, the rate of water temperature rise is about 35–40% for the 100-cc mug and about 60–65% for the 200-cc mug.

These two mugs are denoted A and B. Let us consider only the mug A and suppose that the rate of temperature rise when the mug A is placed on the power feed portion side is X (%) and the time during which the mug A rests in that state is Y (second). As the mounting table turns, the mug A moves to the door side, to the far side from the power feed portion, to the rear side of the heating chamber and back again to the power feed portion side. The rate of temperature rise of the mug A in each state can be expressed as 50%, (100–X)%, 50% and X%. If the time it takes for the mounting table to complete one turn is T seconds, the condition for making the rate of temperature rise of water in the mug A equal to 1.5 times that of water of mug B is given by [Equation 1].

$$100*\{1.5/(1+1.5)\}=(50T+XY)/(T+Y) \quad \text{[Equation 1]}$$

For example, if the time T taken by one complete rotation of the mounting table is 10 seconds and the rest time Y after each complete rotation is 20 seconds, then X=65%. That is, a high level of un-uniformity in the high-frequency intensity distribution that cannot be obtained with the ordinary design is required.

Next, the content of a test conducted will be explained. Two mugs each containing 200 cc of water are put on the mounting table 110 at two locations, one on the left side and one on the right side with respect to the center of the mounting table 110, on a line connecting the power feed portion 109 and the rotating axis center of the rotating support 111. Examinations are made as to the temperature rise characteristics of these water loads as they are heated under the above condition. The mounting conditions areas follows. The mugs are placed in contact with each other at the center of the mounting table; they are placed at the central parts of the left area and the right area; and they are placed at the ends of the mounting table. Then, the diameter of the rotating support 111 is changed so that the rate of temperature rise of the water load located on the power feed side, i.e., the rate of temperature rise of the load located within the detection area of the infrared sensor, would be nearly 1.5–2 times that of the water load on the opposite side. The diameter is determined by choosing a gap between the periphery of the rotating support 111 and the power feed portion 109 according to the propagation wavelength of the high-frequency radiation propagating through the waveguide 108. That is, for the waveguide 108 which has a width of 90 mm and the propagation wavelength of about 166 mm, the diameter of the rotating support 111 is so set that the gap is almost ¼ and ⅜ of the propagation wavelength. In the case of the diameter of about 200 mm, the rates of temperature rise for the left and right water loads are almost equal. As the diameter is increased, the water load on the power feed side is able to be heated more strongly. By considering the relationship with the mounting table 110 and setting the diameter of the rotating support 111 to 245 mm, a desired performance is obtained. In this case, the gap between the periphery of the rotating support 111 and the power feed portion 109 is almost ¼ the propagation wavelength of the high-frequency radiation propagating through the waveguide 108.

When 500-cc beakers (general-purpose containers are used for generalization) each containing 200 cc of water are placed at the central parts of the left area and of the right area of the mounting table on the rotating support shaped as shown in FIG. 3, the rate of temperature rise X obtained is 75% or higher. The rotating support 111 has frames at 90° pitches but the positional relation between the frames and the power feed portion has no effect on the above-described rate of temperature rise.

Figure 4:
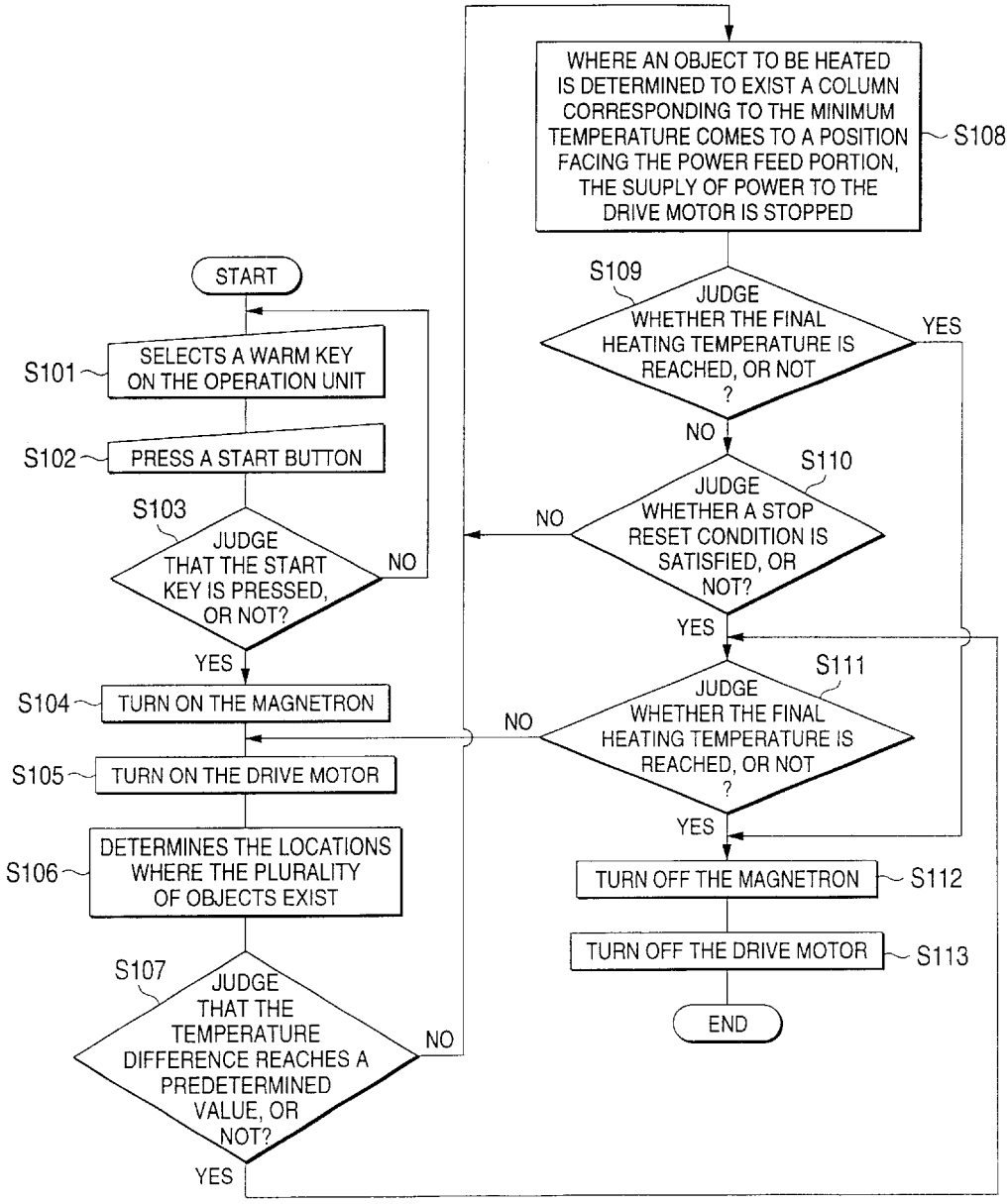

Next, the procedure for operating the high-frequency heating apparatus of the above construction and the control thereof will be explained by referring to FIG. 4. In the following description, the control performed to automatically heat-cooking a plurality of object materials will be explained in order to clarify the features of this invention. After a plurality of objects are put inside the heating chamber, the operator selects a "warm" key on the operation unit (S101). Then, he or she presses a "start" button (S102) to start the dielectric heating of the objects. S103 checks that the "start" key is pressed. If a "cancel" key is pressed before the "start" key, the process returns to S101.

S104 starts the inverter-driven power supply unit 113 to operate the magnetron 107 to supply a high-frequency radiation through the power feed portion 109 into the heating chamber 100. S105 starts the drive motor 112 of the rotating support 111 to rotate the mounting table 110. The drive motor 112 is made up of a synchronous motor and, when the power frequency is 60 Hz, the time required to give the mounting table 110 one turn is 10 seconds.

In S106 the control means 114 counts the elapsed time from when the power is supplied to the drive motor 112 and takes in a detection signal from the infrared sensor 115 at 0.5-second intervals. This detection signal is stored in a 4-row-1-column register 1 representing the current temperature, which holds this signal value until the next signal is entered (i.e., 0.5 second later). The control means 114 also has a register 2 with a 4-row-40-column matrix. This matrix register 2 stores so-called temperature distribution data representing the temperature distribution on the mounting table 110. Upon supplying power to the drive motor 112, the control means 114 immediately takes in the detection signal from the infrared sensor 115 at that point in time and stores it in the register 1. Then, 0.5 second later, the control means transfers the data of the register 1 to a first 4-row-1-column register in the register 2 and then stores the detection signal available at present from the infrared sensor 115 into the register 1. As the operation time of the drive motor 112 elapses, the detection signal is stored into the register 2 successively and, with the elapse of 10 seconds, the temperature distribution over the entire area of the mounting table 110 is stored in the register 2, from the first column to the 20th column. The control means 114 stores the detection data taken in during the next 10 seconds into that area of the register 2 which ranges from 21st column to 40th column. Then, the detection data at and after 20.5 seconds are written over the register 2 beginning with the first column.

The control means 114 compares the data of 1st to 20th column of the register 2 with the data of 21st to 40th column and determines that an object to be heated exists at a column that exceeds a predetermined temperature rise, for example 2° C. Based on the result of comparison, the control means 114 determines the locations where the plurality of objects exist on the mounting table 110 and moves to S107. During this decision processing, because mounting table 110 is continuously rotated, the control means 114 takes in new signals from the infrared sensor 115 at appropriate timings.

Next, S107 compares a temperature difference between a maximum temperature and a minimum temperature (represented by average temperature of each column) of a group of columns in the register 2 where the objects are determined to exist with a predetermined temperature difference, for example 10° C. When the temperature difference is less than 10° C., the control means proceeds to S111 where it compares the maximum temperature with a final heating temperature of each column group. When the final heating temperature is not reached, the control means returns to S105. When the final heating temperature is reached, it proceeds to S112. If S107 decides that the temperature difference is 10° C. or more, the control means proceeds to S108.

At S108, when, in the group of columns in the register 2 where the object to be heated is determined to exist, a column corresponding to the minimum temperature comes to a position facing the power feed portion 109, the supply of power to the drive motor 112 is stopped. At the same time, the counting of the operation time of the drive motor 112 is stopped and the counting of its stop time is started. In this state, the object located at a position facing the power feed portion 109 is dielectric-heated more strongly than the other object. The infrared sensor 115 monitors at all times the surface temperature of only the object that is heated strongly. At this time the data taken in from the infrared sensor 115 is stored only in the register 1.

Next, S109 compares the temperature of the register 1 with the final heating temperature. When the final heating temperature is reached, the control means moves to S112. When the final heating temperature is not reached, it proceeds to S110.

S110 compares the present temperature obtained from the object currently being heated strongly with a stop reset condition for canceling the halt of the rotation of the mounting table and decides whether or not to reset the stop. The stop reset condition is based on the maximum temperature in the temperature distribution of the object that is obtained before the rotation of the mounting table is stopped. If the present temperature of the object currently being strongly heated exceeds this maximum temperature, the rotation stop is reset. Further, if the present temperature data obtained from the object, which is currently heated strongly because of the temperature difference between the maximum and the minimum temperatures obtained prior to the rotation stop of the mounting table, exhibits a predetermined temperature rise from the minimum temperature described above, the stop is reset. The predetermined value at this time is set to, for example, 15° C., 1.5 times the temperature difference. The stop is also reset when the predetermined temperature rise fails to be obtained within a predetermined period of time. The predetermined time may be set to 30 seconds, for example.

When the stop reset condition is not reached, the process returns to S108 which executes its assigned operation. Then, S110 compares the temperature of the register 1 or the stop duration with the stop reset condition. If the condition is met, the control means proceeds to S111 where it checks whether the maximum temperature as the average temperature of each column in the register 2 has reached the predetermined final heating temperature. If the final heating temperature is not reached, the process returns to S105.

S105 supplies a drive power again to the drive motor 112, causing the mounting table 110 to start rotating again. At the same time, the count value of the stop duration of the drive motor 112 is cleared and the counting of the operation time is started again. Further, the detection signal data from the infrared sensor 115 is successively taken into the register 1 and the data in the register 2 is updated. At this time, the column in the register 2 that starts to be updated is the one that held the minimum temperature data at time of executing S108. Hence, the locations of the objects on the mounting table 110 is known at this point. Further, when the drive motor 112 has operated continuously for 20 seconds or more, the data in the register 2 are all updated. In that case, the locations of the objects may be checked again.

When S109 decides that the maximum temperature of the register 1 has reached the final heating temperature or when S111 determines that the average temperature of each column in the register 2 corresponding to the location of the object has reached the final heating temperature, the process proceeds to S112.

S112 stops the operation of the inverter-driven power supply unit 113 and moves to S113. S113 stops the supply of power to the drive motor 112 to finish the dielectric heating of the objects.

Next, detailed operations of the mounting table on which the objects are mounted will be explained by referring to FIG. 5 and FIG. 6.

Figure 5:
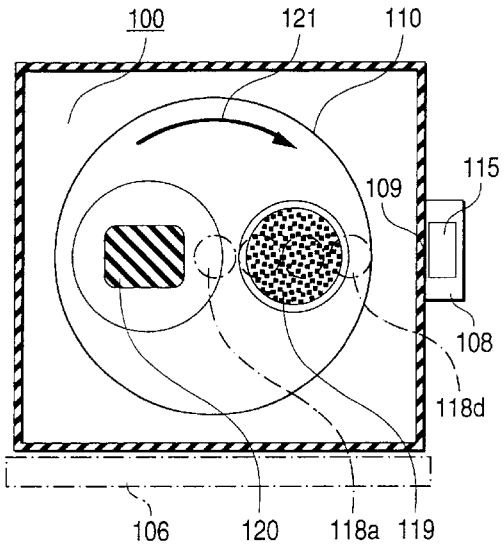
Figure 5:
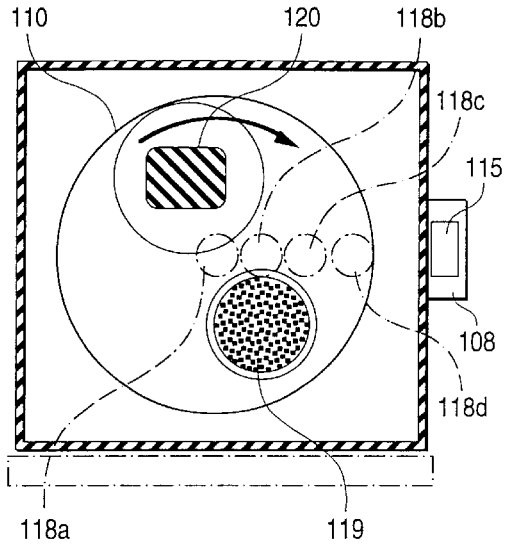

FIG. 5 shows how a frozen rice 119 (−18° C.) and a frozen hamburger 120 (−18° C.) accommodated separately in the apparatus are heated. When the heating is started, the mounting table rotates in a direction of arrow 121. That is, when placed as shown in FIG. 5(*a*), the objects to be heated are moved by the rotation of the mounting table 110 as shown in FIG. 5(*b*). Meanwhile, the control means takes in detection signals from the infrared sensor 115 for the detection areas 118*a*–118*d* at 0.5-second intervals. In the state of FIG. 5(*a*), the infrared sensor 115 detects the temperatures of the frozen rice 119, its bowl and a dish of the frozen hamburger 120. In the state of FIG. 5(*b*), the detection element of the infrared sensor 115 for the detection area 118*a* detects the temperatures of the dish of the frozen hamburger 120 and the mounting table 110; the detection element for the detection area 118*b* detects the temperatures of the bowl of the frozen rice 119 and the mounting table 110; and the detection elements for detection areas 118*c*, 118*d* detect only the temperature of the mounting table 110.

Then, when the mounting table 110 completes one rotation, the control means starts checking the locations of the objects on the mounting table. When the mounting table 110 makes another turn, the control means confirms the presence of a plurality of objects and also knows the temperature information on the objects being heated. If the temperature difference between the maximum and minimum temperatures as average temperatures of those columns in the register 2 where the objects are determined to exist should exceed 10° C., the power to the drive motor is cut off when the column in the register 2 representing the minimum temperature comes to a position facing the power feed portion. As a result, when the mounting table 110 stops with the frozen hamburger 120 for instance located at a position facing the power feed portion, the frozen hamburger 120 is heated more strongly than the frozen rice 119.

Further, in this state if the frozen hamburger 120 is heated to a temperature higher than a desired temperature, the mounting table 110 is rotated again. Then, the somewhat heated rice and the somewhat heated hamburger continue to be dielectric-heated almost evenly. When either the rice or the hamburger reaches the final heating temperature of 75° C., the dielectric heating is ended. In this way, the rice and the hamburger can be heated simultaneously to their proper temperatures.

Figure 6:
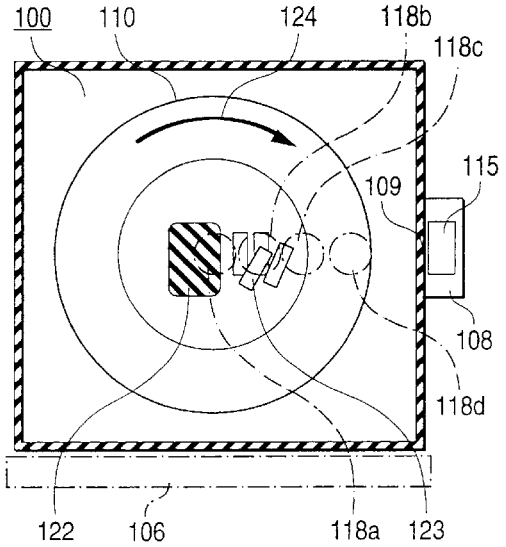
Figure 6:
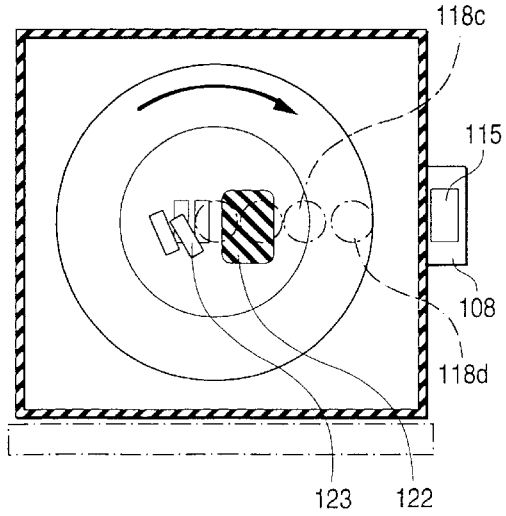

FIG. 6 shows how a frozen hamburger 122 (−18° C.) and frozen potatoes 123 (−18° C.) mounted mixedly are heated. In this case, as the mounting table 110 rotates in the direction of arrow 124, the detection areas 118*a*, 118*b*, 118*c* of the infrared sensor 115 pass over the objects. After the objects' locations are determined as described in the above example, when a column in the register 2 corresponding to the location of the frozen hamburger 122 exhibits a minimum temperature with a greater temperature difference than the predetermined one, the mounting table 110 stops rotating with the frozen hamburger 122 situated at a position that faces the power feed portion and corresponds to the detection areas 118*a*–118*b* of the infrared sensor 115, as shown in FIG. 6(*b*). In this state the frozen hamburger 122 is dielectric-heated more strongly than the frozen potatoes 123. The subsequent operation is the same as described above and when either the hamburger or potatoes reach the final heating temperature, the dielectric heating is ended, at which time both of the objects are at their proper temperatures.

Embodiment 2

Next, embodiment 2 will be described. Embodiment 2 has the power feed portion located on the rear wall of the heating chamber.

Figure 7:
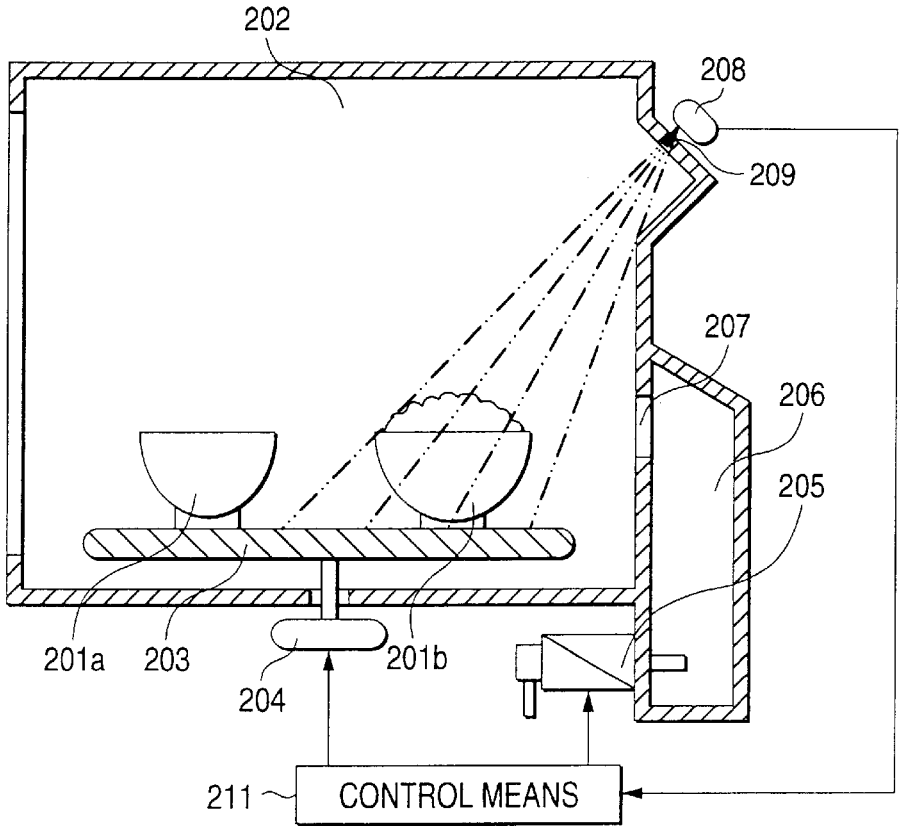
Figure 8:
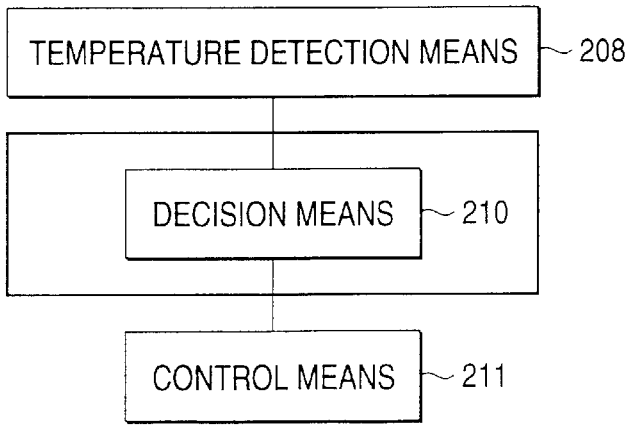
Figure 9:
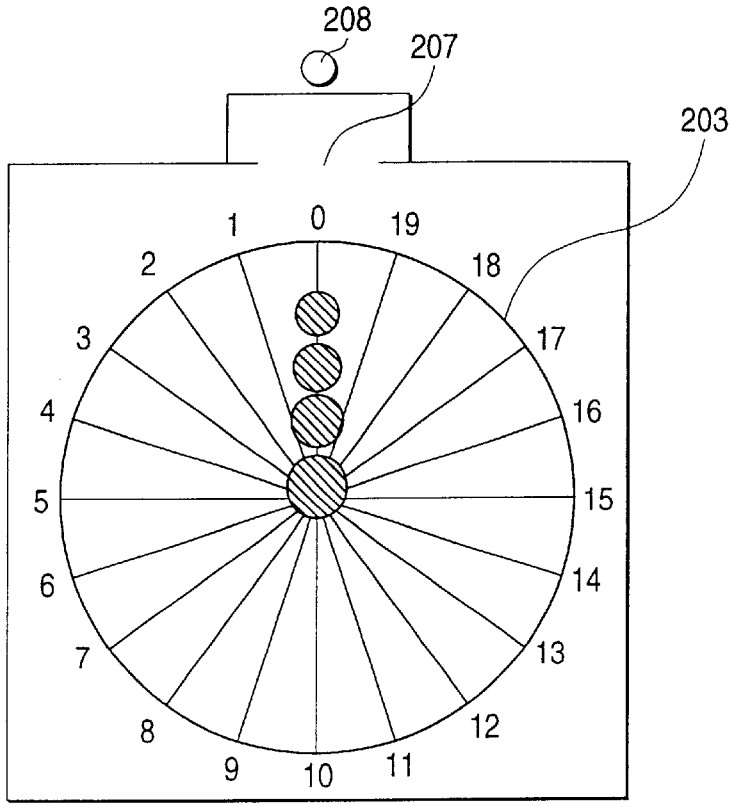
Figure 10:
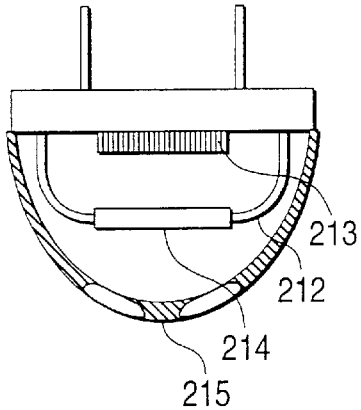
Figure 11:
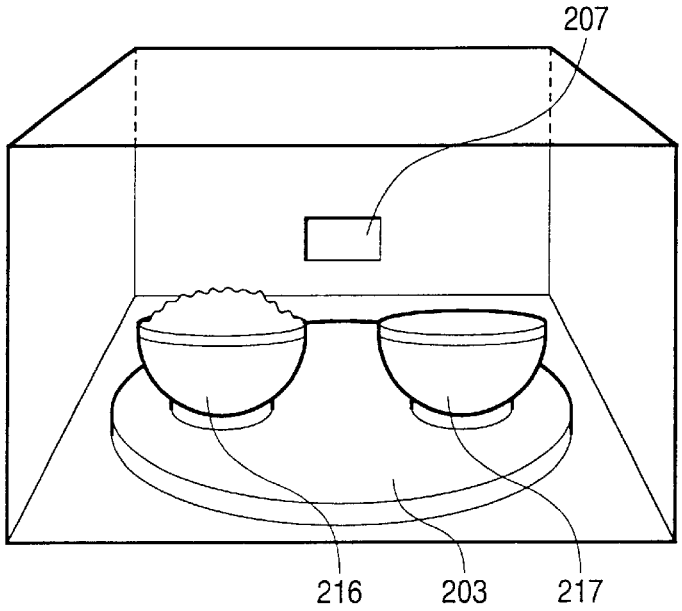
Figure 12:
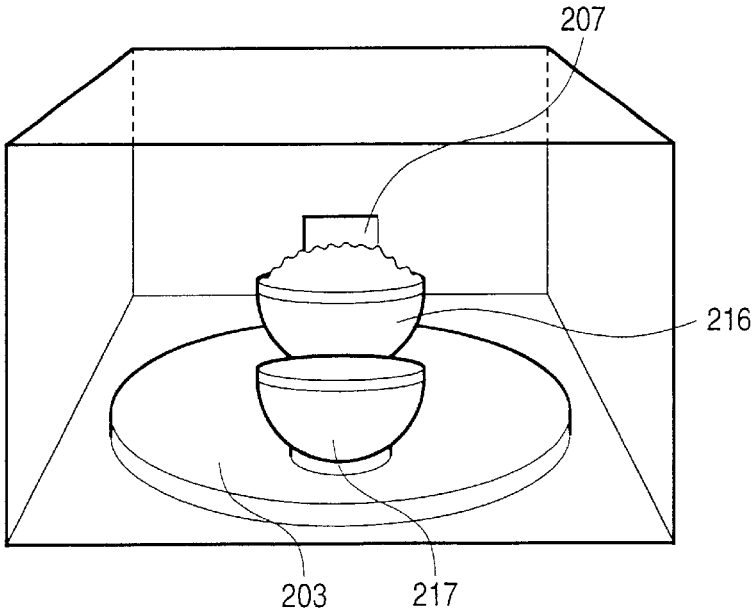
Figure 13:
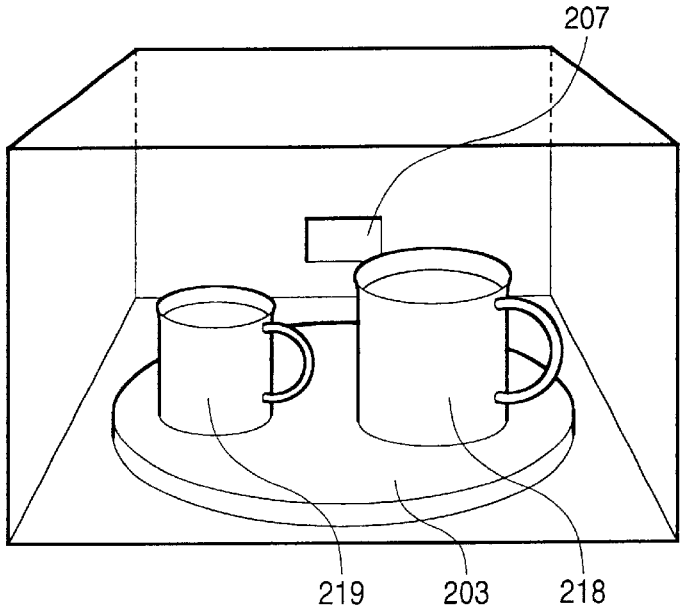
Figure 14:
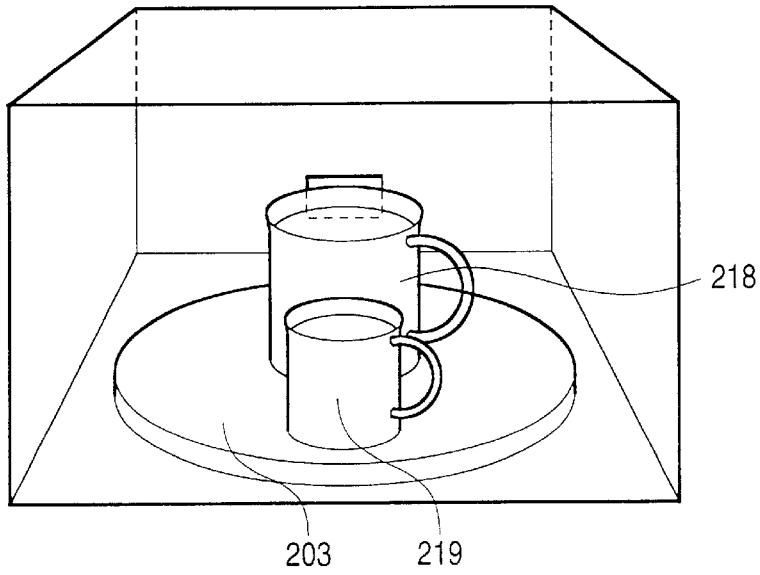
Figure 15:
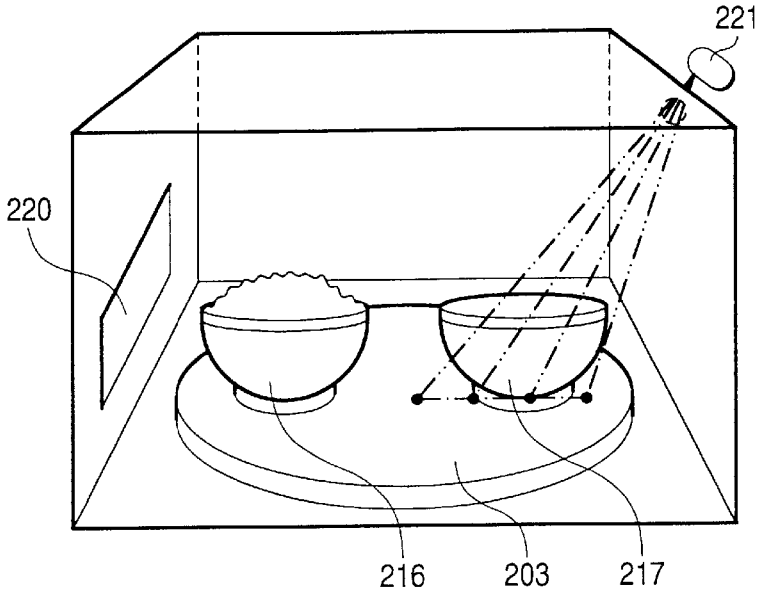

FIG. 7 is a schematic cross section showing the construction of the high-frequency heating apparatus as embodiment 2 of this invention. FIG. 8 is an operation block diagram for the apparatus. FIG. 9 shows an example of addresses allocated to the mounting table of the apparatus. FIG. 10 is an essential-part cross section of the temperature detection means of the apparatus. FIG. 11 is a conceptual diagram showing how a plurality of objects with different heating start temperatures are heated uniformly in the apparatus. FIG. 12 is a conceptual diagram showing how a plurality of objects with different heating start temperatures are high-frequency-heated concentratedly in the apparatus. FIG. 13 is a conceptual diagram showing how large and small cups with different heat absorbing capacities are heated uniformly in the apparatus. FIG. 14 is a conceptual diagram showing how large and small cups with different heat absorbing capacities are high-frequency heated concentratedly in the apparatus. FIG. 15 is a diagram showing relative positions of the power feed portion and the temperature detection means.

In FIG. 7, denoted 201*a* and 201*b* are objects to be heated, such as foods, placed on the mounting table 203. The mounting table 203 is made up of the mounting table and the rotating support shown in embodiment 1 but is schematically illustrated as a one-piece integral structure. The mounting table 203 is rotated in a heating chamber 202 by a rotation drive means 204 to rotate objects 201*a*, 201*b* to be heated. A high-frequency radiation generation means 205 is connected through a waveguide 206 to the heating chamber 202 to feed a high-frequency power into the heating chamber 202 from a power feed portion 207 formed as a rectangular hole. Above the waveguide 206 is provided a temperature detection means 208, which checks the amount of infrared rays from the objects 201*a*, 201*b* through an opening 209 formed in the wall of the heating chamber 202 to detect the temperatures of the objects 201*a*, 201*b*. The temperature detection means 208 has a plurality of detection elements arranged to detect the amount of infrared radiations from four areas spanning nearly the radius segment of the mounting table 203.

FIG. 8 FIG. 8 shows an operation block of the apparatus. Based on signals from the temperature detection means 208, a decision means 210 such as a microcomputer checks a temperature difference. Based on these information, the control means 211 controls the high-frequency radiation generation means 205 and the rotation drive means 204.

FIG. 9 shows the mounting table 203 which is equally divided in a circumferential direction and assigned, for example, a total of 20 addresses. Normally, one object is placed over a plurality of addresses. The temperature of the object is detected by the temperature detection means 208 and taken as the temperature of the associated addresses.

FIG. 10 is an essential-part cross section of the temperature detection means 208. In the figure, four detection elements 213 are installed inside a metal case 212 to detect infrared radiations entering through a window 214 formed of silicon or the like. Outside of the window 214 there is provided a lens 215 formed of plastic that transmits infrared rays. This lens 215 is arranged so that the detection elements 213 can detect temperatures at the associated four points spanning almost the radius segment of the rotating mounting table 203.

The range over which the infrared detection elements 213 can measure temperature is within a circle about 3 cm across. If the range becomes larger, the temperature detection precision degrades increasing errors. Narrowing the measurement range improves the precision but increases cost. Normally, the tray for food in the high-frequency heating apparatus is about 15 cm in radius and thus five infrared detection elements 213 are needed to measure the temperature of the whole radius segment. In this embodiment four detection elements are used, excluding the one for the end portion of the tray. As described above, the number of detection elements is not limited to that of this embodiment and may be determined according to the size of the tray and the required precision.

Next, the operation and the action will be explained.

When, after objects to be heated are accommodated, the high-frequency heating is started, the mounting table 203 starts rotating. When the mounting table 203 completes one turn, the temperature detection means 208 can detect the temperatures of the objects 201*a*, 201*b* on the mounting table 203 from the amount of infrared radiations coming from four points spanning roughly the radius segment of the mounting table 203. The temperature detection means 208 checks the addresses representing the objects 201*a*, 201*b*.

When the decision means 210 determines the temperature difference according to the signals representing the detected temperatures of the plurality of objects 201*a*, 201*b*, the control means 211 controls a rotation mechanism 204 of the mounting table 203 so that the mounting table 203 stops when the address (object being heated) on the low temperature side comes to a position near the power feed portion 207 where the electric field intensity is highest, thereby concentratedly high-frequency-heating the lower-temperature object. As a result, the lower-temperature object 201*b* is temporarily heated concentratedly to reduce the temperature difference, thus realizing the simultaneous heating of a plurality of objects 201*a*, 201*b* to the same temperatures.

Let us explain a case where frozen rice (−20° C.) 216 and cold miso-soup (+5° C.) 217 are mounted on the mounting table 203 as shown in FIGS. 11 and 12.

When the mounting table 203 makes one turn or more after it has started rotating for cooking, the temperatures of a plurality of objects 216, 217 can be detected. Then, if the temperature difference is checked and decided to be larger than a predetermined value, the mounting table 203 is stopped when the frozen rice 216, the lower-temperature food, comes near the power feed portion 207 where the electric field intensity is highest, thus temporarily heating the frozen rice 216 concentratedly. This reduces the temperature difference. When the temperature difference becomes smaller than a predetermined value, the rotation mechanism 204 may, for example, be controlled to rotate the mounting table 203 again to high-frequency-heat both of the objects 216, 217 almost evenly to the same desired temperatures.

Next, as a case of heating a plurality of objects with different heat absorbing capacities, we will explain about an example in which a large amount of milk 218 in a large cup and a small amount of milk 219 in a small cup are heated simultaneously, as shown in FIG. 13 and FIG. 14.

First, as the mounting table 203 is rotated, a plurality of objects 218, 219 begin to be heated almost evenly. Then the temperatures of the objects 218, 219 can be detected. Because the amount of milk 218 in a large cup is larger, the temperature rise is smaller thus increasing the temperature difference. When the temperature difference becomes larger than a predetermined value of 5° C., for example, the milk 218 in the larger cup which is lower in temperature is temporarily heated concentratedly by stopping the mounting table 203 when the milk 218 comes to a position near the power feed portion 207 where the electric field intensity is highest. This reduces the temperature difference. When the temperature difference is smaller than a predetermined value of, say, 0° C., the rotation mechanism 204 is controlled to rotate the mounting table 203 again to high-frequency-heat the both objects 218, 219 almost evenly to the same desired temperatures. If the amounts of foods differ greatly and the difference of their heat absorbing capacities is large, the stopping and rotating of the mounting table during the high-frequency heating may be repeated.

As described above, the invention enables the simultaneous heating to the same temperatures of such food combinations commonly experienced in daily life as frozen rice and cold miso-soup, frozen rice and frozen hamburger, and frozen shao-mai and cold rice. This is very useful. Even in cases where different foods have different heat absorbing capacities, as when milk in a large cup and milk in a small cup are heated simultaneously, they can be heated to have the same temperatures at the end of the simultaneous heating operation. This is also very useful. Further, because the power feed portion is not varied, there is no possibility of unwanted heat or spark being produced due to electric field concentrations. There is no complex mechanisms such as a waveguide moving means and a power feed portion position changing means, allowing the apparatus to be constructed in a simple structure.

As described above, with the temperature detection means 208 which takes roughly the radius segment of the mounting table 203 as its angle of view when performing simultaneous heating of a plurality of objects, the temperatures of a plurality of objects can be detected by rotating the mounting table 203. Hence, there are no particular conditions as to the positions of the temperature detection means 208 on the heating chamber 202 but it needs only to be situated at a position above the objects to be heated where it can command an entire view of the objects as practically as possible.

When a concentrated high-frequency heating is performed, the rotation of the mounting table 203 is stopped so that one of the objects is situated near the power feed portion 207. Therefore, with the temperature detection means 208 that uses roughly the radius segment of the mounting table 203 as its angle of view, the temperature detection can no longer be made unless an appropriate location is set as the detection viewing field.

For example, let us consider a case where, as shown in FIG. 15, a temperature detection means 221 is located on a side wall opposite a side wall formed with a power feed portion 220 and takes almost the radius segment of the mounting table 203 as its angle of view directed toward the center of the mounting table 203. In this construction, during the uniform heating by the rotation of the mounting table 203, the temperature detection means 221 can detect the temperatures of the objects 216, 217 on the mounting table 203. However, during the concentrated heating in which the mounting table 203 is stopped so that the lower-temperature object 216 is located near the power feed portion 220 for concentrated heating, it is not possible to detect the temperature of the lower-temperature object 216. That is, with the temperature detection means 221 that takes almost the radius segment of the mounting table 203 as its angle of view, there is a correlation between the position of the temperature detection means 221 and the position of the power feed portion 220 and it is therefore important to take a line connecting the power feed portion 220 and the center of the mounting table 203 into the field of view.

The apparatus of this invention is characterized by a combination of heating modes—the uniform heating in which the mounting table 203 carrying a plurality of objects to be heated is rotated and the concentrated heating in which, according to the decisions made on the temperatures and on the temperature difference, the mounting table 203 is stopped to locate the lower-temperature object at a position near the power feed portion 207 for concentrated heating of the object. Because the temperature detection means 208 for detecting temperatures of a plurality of locations using a plurality of detection elements 213 (four elements) takes almost the radius segment of the mounting table 203 as the angle of view, the apparatus is also characterized in that the line connecting the power feed portion 207 and the center of the mounting table 203 is taken as the angle of view and that, during the concentrated heating, a heating control is also performed which occasionally rotates the mounting table 203 to detect the temperature of the other object to determine the temperature difference.

This invention combines the temperature detection means, which takes almost the radius segment of the mounting table 203 as its angle of view covered by a plurality of infrared detection elements, with the heating control for determining the temperature difference, thereby making it possible to precisely detect the temperatures with low cost. Further, the overall configuration becomes very simple.

Embodiment 3

Figure 16:
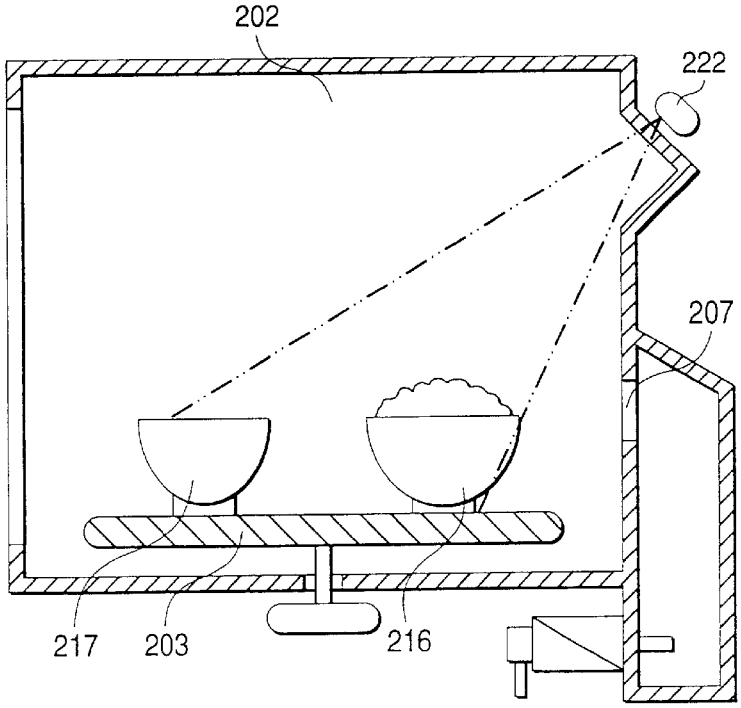
Figure 17:
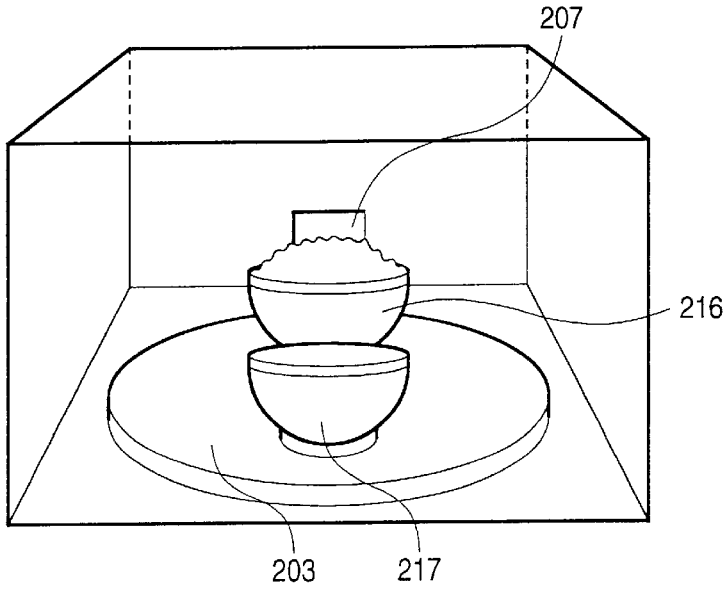

FIG. 16 is a schematic view of a high-frequency heating apparatus according to embodiment 3 of this invention, showing a temperature detection means which takes roughly the diameter segment of the mounting table as its view angle. FIG. 17 is a front conceptual diagram of FIG. 16 during a concentrated heating.

Differences from the embodiment 2 will be described.

Both when the mounting table is rotating and when it is stopped, a temperature detection means 222 uses, as its angle of view covered by a plurality of infrared detection elements (for example, eight elements), the diameter segment of the mounting table 203 on the line connecting the power feed portion 207 and the center of the mounting table 203. When a plurality of objects 216, 217 are high-frequency-heated almost evenly, the mounting table 203 is rotating and thus it is not necessarily required to take roughly the diameter segment of the mounting table 203 as its angle of view. But during the concentrated heating of the lower-temperature object 216, because the mounting table 203 is stopped, detection of the temperature of the other object 217, not the lower-temperature object, requires roughly the diameter segment of the table to be used as the view angle. That is, where roughly the radius segment of the mounting table 203 is used as the angle of view, it is necessary during the concentrated heating to perform a heating control that occasionally rotates the mounting table 203 to detect the temperature of the other object and thereby determine the temperature difference. The configuration of this embodiment, however, has no such need.

Although in this embodiment the power feed portion 207 is provided on the rear wall of the heating chamber 202, it should be noted that the temperature detection means 222 and the power feed portion 203 may be installed on separate walls as long as the temperature detection means 222 is provided over the line connecting the power feed portion 207 and the center of the mounting table 203.

The temperature detection means according to this invention uses roughly the diameter segment of the table as its angle of view covered by a plurality of infrared detection elements and obviates the need to add the heating control for determining the temperature difference although the increased number of detection elements (for example, eight elements) may somewhat raise the cost.

Embodiment 4

Figure 18:
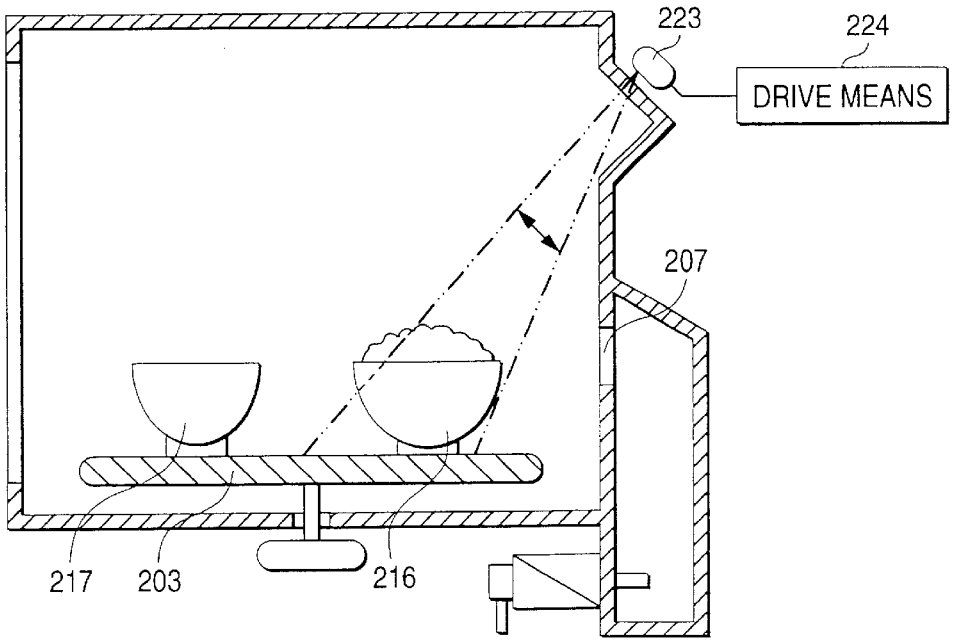

FIG. 18 is a schematic diagram of a high-frequency heating apparatus as embodiment 4 of this invention, showing a temperature detection means made up of a single detection element driven by a drive means.

Differences from embodiments 2 and 3 will be described.

When the mounting table 203 is rotating, the temperatures of objects being heated are detected by a combination of a temperature detection means 223 with a single infrared detection element and a drive means 224. The drive means 224 swings the temperature detection means 223 on the line connecting the power feed portion 207 and the center of the mounting table 203 to take roughly the radius segment of the mounting table 203 as its angle of view.

When the address determined to represent the object being heated reaches that radius segment of the mounting table 203 which is being monitored by the temperature detection means 223, a heating control is performed which involves stopping the rotation of the mounting table 203 for a few seconds and at the same time swinging the temperature detection means 223 by an amount roughly equal to the radius segment of the mounting table 203, thus enhancing the temperature detection precision.

Let us consider a case where frozen rice (−20° C.) 216 and cold miso-soup (+5° C.) 217 are placed on the mounting table 203 for simultaneous heating. As the mounting table 203 rotates, a plurality of objects 216, 217 are high-frequency-heated and their progressively increasing temperatures are detected by the temperature detection means 223. If the temperature difference is found, when the frozen rice 216, the lower-temperature object, comes to a position near the power feed portion 207 where the electric field intensity is strongest, the mounting table 203 is stopped to temporarily heat the object concentratedly. At this time, the temperature detection means 223 is detecting the temperature of the frozen rice 216. To check the temperature difference from the temperature of miso-soup (+5° C.) 217, a heating control is also performed to occasionally rotate the mounting table 203 during the concentrated heating.

With this invention, although a stepping motor is needed for the swing drive and the heating control for checking the temperature difference needs to be performed, the temperature detection means has a minimum number of detection elements, realizing a reduced cost.

Embodiment 5

Figure 19:
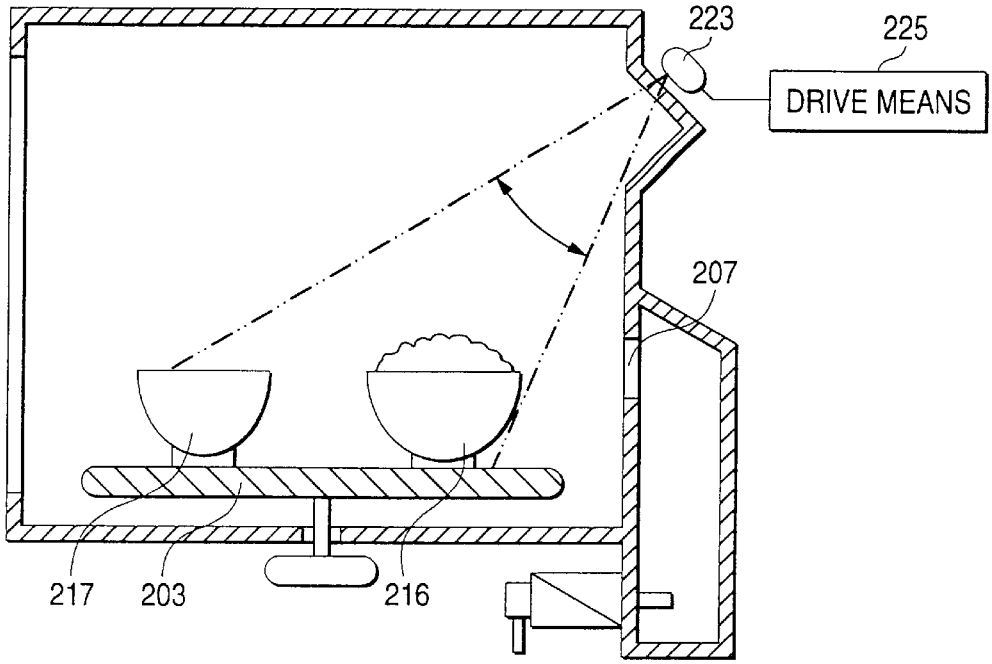

FIG. 19 is a schematic diagram of a high-frequency heating apparatus as embodiment 5 of this invention, showing a single detection element and a drive means.

Differences from embodiments 2–4 will be described.

When the mounting table 203 is rotating, a combination of a temperature detection means 223 with a single infrared detection element and a drive means 225 is used and the drive means 225 swings the temperature detection means 223 on the line connecting the power feed portion 207 and the center of the mounting table 203 to take roughly the radius segment of the mounting table 203 as its angle of view.

As in embodiment 4, when the address determined to represent the object being heated reaches that radius segment of the mounting table 203 which is being monitored by the temperature detection means 223, a heating control is performed which involves stopping the rotation of the mounting table 203 for a few seconds to swing the temperature detection means 223 by an amount roughly equal to the radius segment of the mounting table 203, thus enhancing the temperature detection precision.

During the concentrated heating, the drive means 225 swings the temperature detection means 223 made up of a single infrared detection element on the line connecting the power feed portion 207 and the center of the mounting table 203 so that roughly the diameter segment of the mounting table 203 can be taken as the angle of view.

Let us consider a case where frozen rice (−20° C.) 216 and cold miso-soup (+5° C.) 217 are placed on the mounting table 203 for simultaneous heating. If the temperature difference is found, when the frozen rice 216 comes to a position near the power feed portion 207 where the electric field intensity is strongest, the mounting table 203 is stopped to temporarily heat the object concentratedly. Here, the difference from embodiment 4 is that the drive means 225 swings the temperature detection means 223 so that the diameter of the mounting table 203 can be taken as the angle of view, thus allowing the temperatures of both the frozen rice 216 and the cold miso-soup 217 to be detected.

This invention requires a stepping motor for the swing drive and needs to additionally perform the drive control operations, one taking the radius as the angle of view and one taking the diameter as the angle of view. But this invention eliminates the need for the heating control to check the temperature difference and the temperature detection means has the minimum number of elements, realizing a reduced cost.

A further embodiment will be described.

Both during the mounting table rotation heating and during the concentrated heating, a combination of a temperature detection means 223 with a single infrared detection element and a drive means 225 is used and the drive means 225 swings the temperature detection means 223 on the line connecting the power feed portion 207 and the center of the mounting table 203 to take roughly the diameter segment of the mounting table 203 as its angle of view.

The difference from the preceding embodiments is whether, during the mounting table rotation heating, the temperature detection means 223 takes roughly the radius segment or diameter segment of the mounting table 203 as its angle of view. The diameter of the mounting table 203 varies according to the heating capacity of the apparatus. This embodiment is one of the options dependent on these conditions.

Embodiment 6

Figure 20:
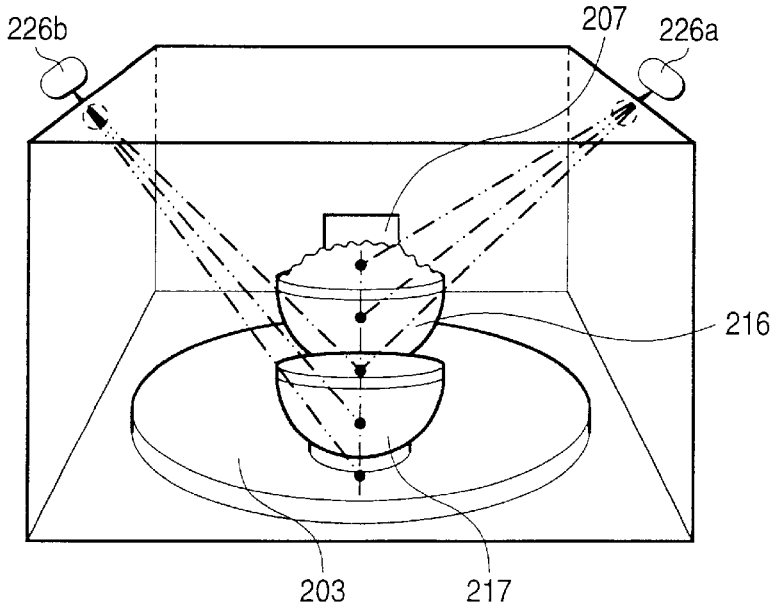
Figure 21:
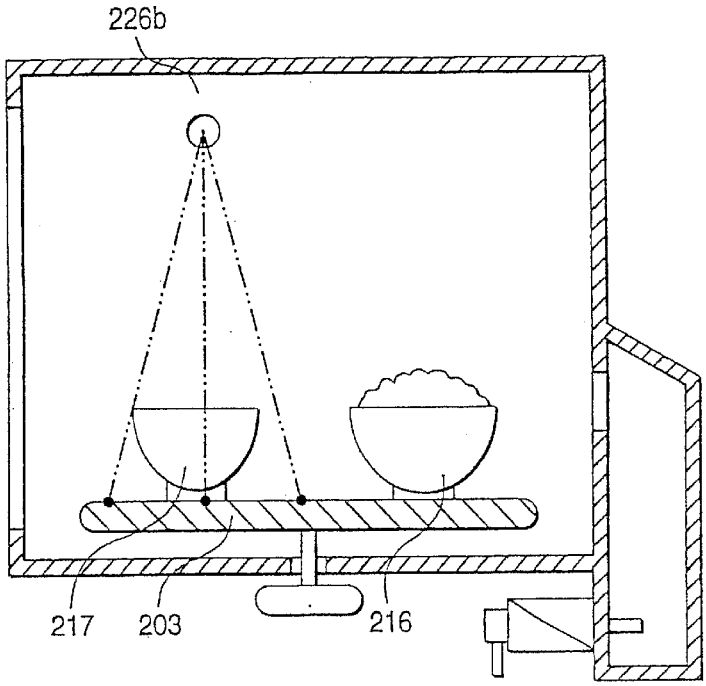
Figure 22:
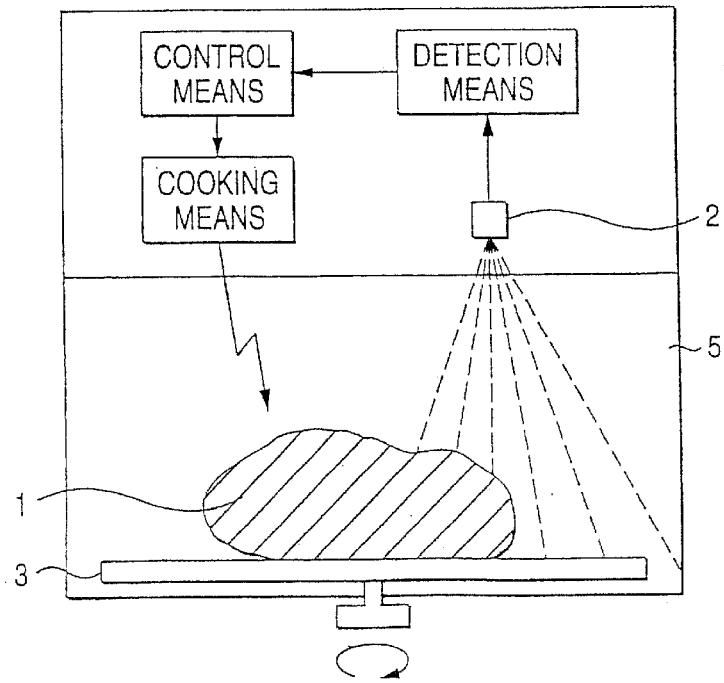
FIG. 22 (PRIOR ART)
Figure 23:
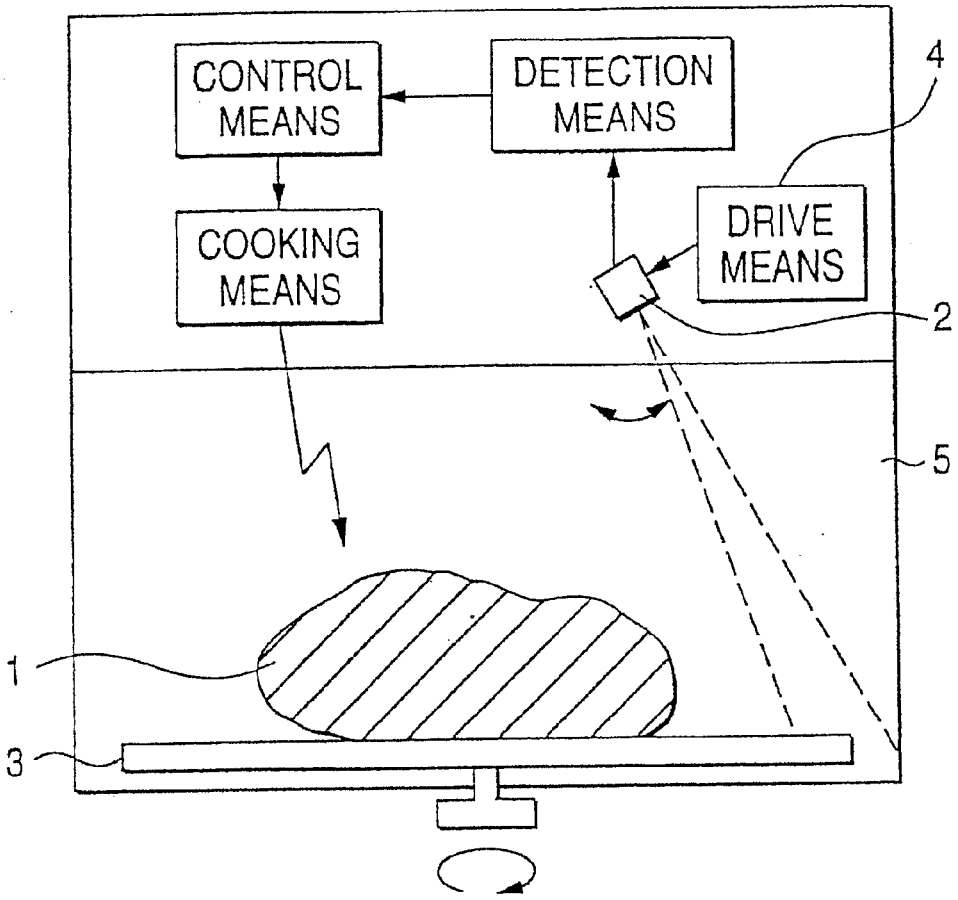
FIG. 23 (PRIOR ART)
Figure 24:
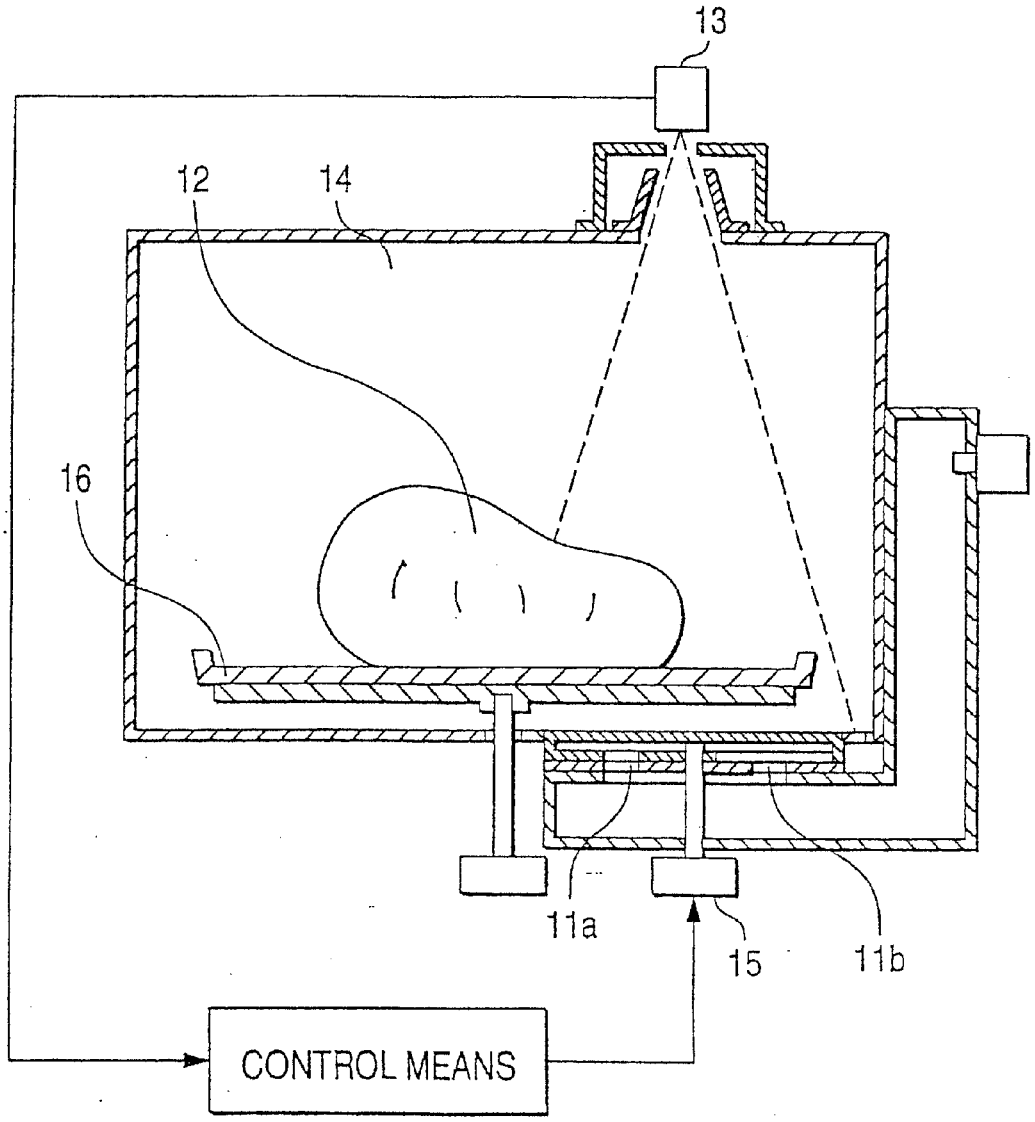
FIG. 24 (PRIOR ART)
Figure 25:
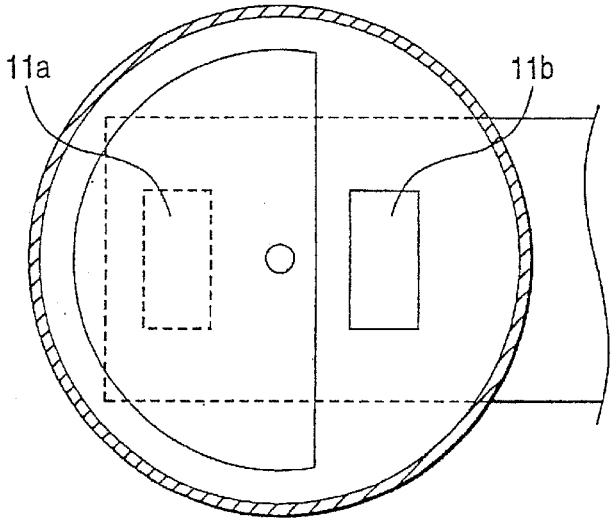
FIG. 25 (PRIOR ART)
Figure 26:
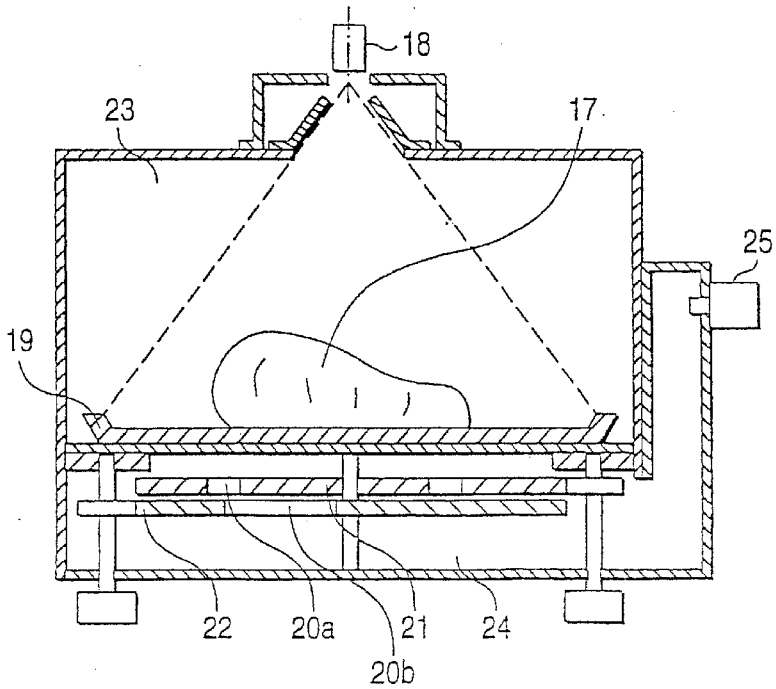
FIG. 26 (PRIOR ART)
Figure 27:
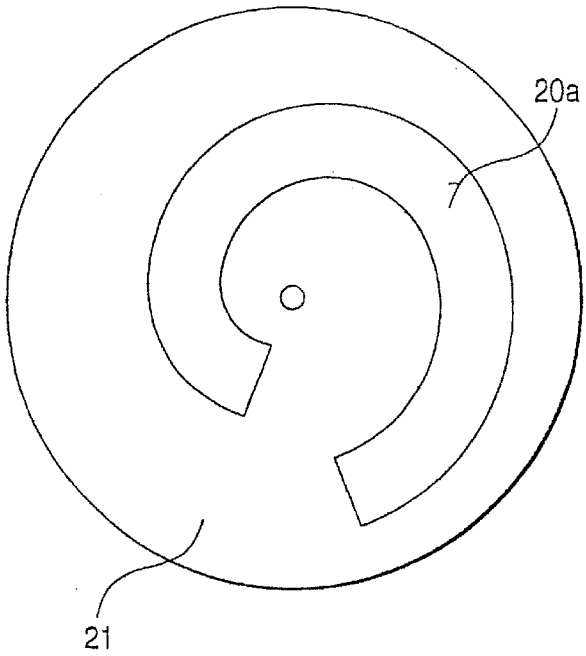
FIG. 27 (PRIOR ART)
Figure 28:
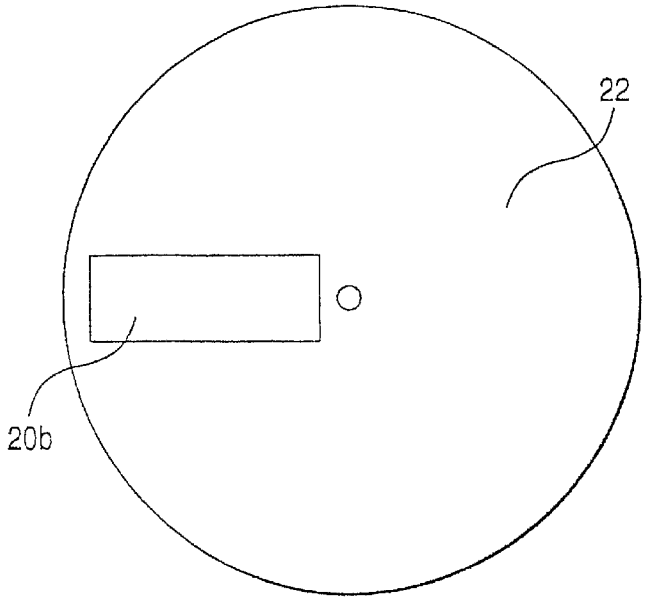
FIG. 28 (PRIOR ART)

FIG. 20 is a conceptual diagram of a high-frequency heating apparatus as embodiment 6 of this invention, showing a plurality of temperature detection means during the concentrated heating. FIG. 21 is a schematic side view of the apparatus.

The differences from embodiments 2–5 will be described.

A temperature detection means is of a multiple type which comprises a combination of temperature detection means A and B 226*a*, 226*b*. Both during the mounting table rotation heating and during the concentrated heating, the temperature detection means A 226*a* uses, as its angle of view covered by a plurality of infrared detection elements (for example, two to three elements), roughly the radius segment of the mounting table 203 on the line connecting the power feed portion 207 and the center of the mounting table 203 while the temperature detection means B 226*b* uses approximately the remaining radius segment of the mounting table 203 as its angle of view.

First, during the mounting table rotation heating in which a plurality of objects 216, 217 are heated by rotating the mounting table 203, both of the temperature detection means 226*a*, 226*b* are used to detect the temperatures. Unlike embodiments 2–5 that measure temperatures every one turn of the mounting table 203, this embodiment can check the temperatures every ½ rotation of the mounting table 203.

Next, during the concentrated heating with the mounting table stopped, the lower-temperature object 216 is heated near the power feed portion 207 temporarily by stopping the rotation of the mounting table 203. At this time, the temperatures of both the frozen rice 216 and the cold miso-soup 217 can be detected by the temperature detection means A, B 226*a*, 226*b*.

With this invention, although the use of a plurality of temperature detection means, each having a plurality of detection elements, may raise the cost slightly, there is no need to add the control for checking the temperature difference, which in turn increases the speed of temperature detection and enhances the precision of the heating control.

In the above embodiments, we have described cases where two different kinds of objects are simultaneously heated. Three different kinds of objects can be heated simultaneously in a way similar to that of the simultaneous heating of two objects. That is, when three objects are heated at the same time, at first they are heated by rotating the mounting table. At some point later, of the three objects, the one with the lowest temperature is selected. When the selected object comes to a position where the intensity of radiation is strong, the mounting table rotation is stopped to heat the object under the strong radiation. Then, the mounting table is rotated again to repeat the above-described process, thereby heating all the objects to proper temperatures. Heating four objects of different states simultaneously can also be performed in the similar manner.

Where only one object is heated and is so large that there are temperature variations in that object, it is still possible to heat the entire one object to an appropriate temperature based on a method similar to that of this embodiment by assuming the object to consist of a high-temperature object and a low-temperature object.

As described above, with this embodiment, high-frequency radiation intensity variations are formed by the power feed portion and the rotating support; and the difference between the strong and weak radiations are utilized to heat the low-temperature object with a strong radiation and the high-temperature object with a weak radiation, thus heating the objects as a whole to an appropriate temperature.

Industrial Applicability

As described above, this invention uses the power feed portion and the rotating support to positively form high-frequency radiation intensity variations in the heating chamber; to select at some point during the mounting table rotation heating one of objects being heated or one part of an object being heated which is lowest in temperature information; to stop the rotation of the mounting table when the selected object or selected part comes to a position where the radiation is strong; and to strongly heat the low-temperature object or part under the strong radiation. By repeating this process the objects are heated. It is thus possible to heat all of different objects or one entire object to an appropriate temperature.

The temperature detection means using roughly the radius segment of the mounting table as an angle of view covered by a plurality of detection elements is combined with a heating control that checks the temperature difference. This configuration enables a precise detection of temperature at low cost.

Further, because the temperature detection means uses the diameter of the mounting table on the line connecting the power feed portion and the center of the mounting table as its angle of view covered by a plurality of infrared detection elements both during the uniform heating and during the concentrated heating, there is no need to add a heating control for checking the temperature difference although the increased number of detection elements (e.g., eight elements) in the temperature detection means may raise the cost slightly.

Further, during the uniform heating the temperature is detected by the temperature detection means which uses roughly the radius segment of the mounting table on the line connecting the power feed portion and the center of the mounting table as its angle of view covered by a single infrared detection element combined with the drive means. During the concentrated heating, the above temperature detection means is combined with a heating control which occasionally rotates the mounting table during heating to check the temperature difference between a plurality of objects. Although this arrangement requires a stepping motor for the swing drive and needs to additionally perform the control for checking the temperature difference, the temperature detection means has a minimum number of detection elements, which reduces the cost.

Further, during the uniform heating the temperature is detected by the temperature detection means which uses roughly the radius segment of the mounting table on the line connecting the power feed portion and the center of the mounting table as its angle of view covered by a single infrared detection element combined with the drive means. During the concentrated heating, the temperature detection means uses roughly the diameter segment of the mounting table on the line connecting the power feed portion and the center of the mounting table as its angle of view covered by a single infrared detection element combined with the drive means. Although this arrangement requires a stepping motor for the swing drive and needs to additionally perform the drive controls, on taking the radius as the angle of view and one taking the diameter as the angle of view, there is no need to perform an additional control for checking the temperature difference and the temperature detection means has a minimum number of detection elements, realizing a reduced cost.

Further, the temperature detection means is of a multiple type which comprises a combination of temperature detection means A and B. Both during the uniform heating and during the concentrated heating, the temperature detection means A uses, as its angle of view covered by a plurality of infrared detection elements, roughly the radius segment of the mounting table on the line connecting the power feed portion and the center of the mounting table while the temperature detection means B uses approximately the remaining radius segment of the mounting table as its angle of view. Although the use of a plurality of temperature detection means, each having a plurality of detection elements, may raise the cost slightly, there is no need to add the control for checking the temperature difference, which in turn makes the arrangement simple.

Further, when a plurality of objects having different temperatures at the start of heating operation or a plurality of objects having different heat absorbing capacities are to be heated simultaneously, they can be heated to have almost the same temperatures at the end of the heating operation.

This invention can solve various inconveniences experienced with the conventional apparatus that heats objects separately and can heat a plurality of foods in one-half the time taken by the conventional apparatus. Further, because a plurality of foods are heated simultaneously to a desired temperature, they all can be served while they are best for eating. This should be very convenient for a large family.

Further, the mounting table is controlled to stop when the lower-temperature object comes to a position near the power feed portion where the electric field intensity is strongest. This arrangement does not make any change to the power feed portion. Nor does it require a complicated mechanism such as a waveguide moving means or opening position changing means. Because the apparatus of this invention can perform the simultaneous heating to the same temperature with a simple construction, it offers a great practical value.

What is claimed is:

1. A high-frequency heating apparatus comprising:

a mounting table on which to mount an object to be heated;

rotation drive means to rotate said mounting table;

temperature detection means to cover almost an entire area of said mounting table as a detection area by rotating said mounting table;

radiation variation means to form variations in a high-frequency radiation intensity in a heating chamber; and control means to stop the rotation of said mounting table when a lowest temperature object comes to where the radiation is strong and heat the object while monitoring a surface temperature of the object by said temperature detection means, wherein said control means restarts to rotate said mounting table when present temperature data obtained from an object on heating shows a predetermined temperature rise from the lowest temperature, the predetermined temperature rise is determined based on temperature differentials between highest temperature and lowest temperature obtained from said temperature detection means before said mounting table stops to rotate.

2. A high-frequency heating apparatus comprising:

a mounting table on which to mount an object to be heated;

rotation drive means to rotate said mounting table;

temperature detection means to cover almost an entire area of said mounting table as a detection area by rotating said mounting table;

radiation variation means to form variations in a high-frequency radiation intensity in a heating chamber; and control means to stop the rotation of said mounting table when a lowest temperature object comes to where the radiation is strong and heat the object while monitoring a surface temperature of the object by said temperature detection means, wherein said control means restarts to rotate said mounting table when present temperature data obtained from an object on heating shows a predetermined temperature rise from the lowest temperature, the predetermined temperature rise is determined based on temperature differentials between highest temperature and lowest temperature obtained from said temperature detection means before said mounting table stops to rotate, wherein said radiation means comprises a power feed portion for supplying a high-frequency power to said heating chamber accommodating the object and a rotating support on which to mount a mounting table, and wherein, a gap between a peripheral part of the rotating support and the power feed portion is equal to about ¼ a propagation wavelength of the high-frequency radiation in a waveguide that transmits the high-frequency radiation generated by a high-frequency radiation generation means to the power feed portion.

3. A high-frequency heating apparatus comprising:

a power feed portion to supply a high-frequency power to a heating chamber;

a mounting table to mount a plurality of objects to be heated thereon and apply more of the high-frequency power to the object located near the power feed portion than to objects located elsewhere;

a temperature detection means to detect temperatures of the plurality of objects when said mounting table is rotating and, when said mounting table is stopped, monitor a temperature change of at least the object near the power feed portion;

a decision means to determine a temperature difference between the objects being heated based on a detection result obtained from said temperature detection means when said mounting table is rotating; and a control means to stop the rotation of said mounting table when the lower-temperature object comes near the power feed portion according to a decision made by said decision means and to heat the object concentratedly and at the same time occasionally rotate said mounting table to check for a possible change of the lower-temperature object.

4. The high-frequency heating apparatus according to claim 3, wherein said temperature detection means has a plurality of infrared detection elements to detect temperatures by taking roughly a radius segment of said mounting table on a line connecting the power feed portion and a center of said mounting table as an angle of view covered by said plurality of detection elements.

5. The high-frequency heating apparatus according to claim 3, wherein said temperature detection means has a plurality of infrared detection elements to detect temperatures by taking roughly a diameter segment of said mounting table on a line connecting the power feed portion and a center of said mounting table as an angle of view covered by said plurality of detection elements.

6. The high-frequency heating apparatus according to claim 3, wherein said temperature detection means has a single infrared detection element combined with a drive means to detect temperatures by taking roughly a radius segment of said mounting table on a line connecting the power feed portion and a center of said mounting table as an angle of view.

7. The high-frequency heating apparatus according to claim 3, wherein said temperature detection means has a single infrared detection element combined with a drive means to detect temperatures by taking roughly a radius segment of said mounting table on a line connecting the power feed portion and a center of said mounting table as an angle of view when said mounting table is rotating and, when said mounting table is at rest, taking roughly a diameter segment of said mounting table on a line connecting the power feed portion and a center of said mounting table as an angle of view.

8. The high-frequency heating apparatus according to claim 3, wherein said temperature detection means comprises a combination of a temperature detection means A and a temperature detection means B, each having a plurality of infrared detection elements, said temperature detection means A being adapted to take roughly a radius segment of said mounting table on a line connecting the power feed portion and a center of the mounting table as an angle of view, said temperature detection means B being adapted to take roughly a remaining radius segment of said mounting table as an angle of view.

9. A high-frequency heating apparatus comprising:

a heating chamber to accommodate objects to be heated;

high-frequency radiation generation means to generate a high-frequency radiation;

a power feed portion to supply the high-frequency radiation generated by said high-frequency radiation generation means to said heating chamber;

a drive power supply to drive said high-frequency radiation generation means;

a mounting table on which to mount the objects to be heated;

a rotating support on which to mount said mounting table and to form variations in a high-frequency radiation intensity in said heating chamber in cooperation with the power feed portion;

rotation drive means to drive said rotating support;

temperature detection means to cover almost an entire area of said mounting table as a detection area as said mounting table rotates; and control means to control the operations of said drive power supply and said rotation drive means according to a temperature distribution of the objects as represented by a detection signal from said temperature detection means and utilize the variations in the high-frequency radiation intensity in heating a lower-temperature object with a strong high-frequency radiation and heating a higher-temperature object with a weak high-frequency radiation to heat the entire objects with high-frequency radiations to an appropriate temperature, wherein said control means controls said rotation drive means so that when the control means decides that a temperature difference between maximum and minimum temperatures in a temperature distribution of the objects as represented by the detection signal from said temperature detection means exceeds a predetermined value, the minimum temperature object is brought to a position facing the power feed portion where the high-frequency radiation is strong before stopping the rotation of said mounting table, and that when a predetermined stop reset condition is met, said mounting table is rotated again.

10. The high-frequency heating apparatus according to claim 9, wherein the stop reset condition is an absolute temperature value based on the maximum temperature in the temperature distribution of the objects obtained before said mounting table stopped rotating or a temperature rise value based on the temperature difference between the maximum and minimum temperatures.

11. The high-frequency heating apparatus according to claim 9 wherein the stop reset condition is a predetermined rest time associated with the stopping of the rotation of said mounting table.

12. A high frequency heating apparatus comprising:

a mounting table on which to mount an object to be heated;

rotation drive means to rotate said mounting table;

temperature detection means to cover almost an entire area of said mounting table as a detection area by rotating said mounting table;

radiation variation means to form variations in a high frequency radiation intensity in a heating chamber; and control means to stop the rotation of said mounting table when a lowest temperature object comes to where the radiation is strong and heat the object while monitoring a surface temperature of the object by said temperature detection means, wherein said control means restarts to rotate said mounting table when present temperature data obtained from an object on heating shows a predetermined temperature rise from the lowest temperature, the predetermined temperature rise is determined based on highest temperature and lowest temperature obtained from said temperature detection means before said mounting table stops to rotate.

* * * * *